US006741239B2

(12) United States Patent
Iwasaki

(10) Patent No.: US 6,741,239 B2
(45) Date of Patent: May 25, 2004

(54) LCD POWER SOURCE CONTROL METHOD AND CONTROL CIRCUIT THEREOF AND IMAGE FORMING APPARATUS HAVING THE CONTROL CIRCUIT

(75) Inventor: Kazuya Iwasaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 143 days.

(21) Appl. No.: 10/091,501

(22) Filed: Mar. 7, 2002

(65) Prior Publication Data

US 2002/0126113 A1 Sep. 12, 2002

(30) Foreign Application Priority Data

Mar. 7, 2001 (JP) ..... 2001-063992
Feb. 4, 2002 (JP) ..... 2002-026563

(51) Int. Cl.[7] ..... G09G 5/00

(52) U.S. Cl. ..... 345/211; 345/87; 345/212; 345/213

(58) Field of Search ..... 345/87, 211–213, 345/204, 92, 94, 98–99, 100

(56) References Cited

U.S. PATENT DOCUMENTS 5,465,054 A * 11/1995 Erhart ..... 326/34
5,510,814 A * 4/1996 Ise ..... 345/211
5,604,449 A * 2/1997 Erhart et al. ..... 326/81
5,648,799 A * 7/1997 Kikinis ..... 345/212
5,712,692 A * 1/1998 Kanagawa et al. ..... 348/790
5,969,512 A * 10/1999 Matsuyama ..... 323/272
6,064,360 A * 5/2000 Sakaedani et al. ..... 345/92
6,166,726 A 12/2000 Uchida et al.

FOREIGN PATENT DOCUMENTS

JP 11-219147 8/1999
JP 11-282427 10/1999

* cited by examiner

*Primary Examiner*—Richard Hjerpe
*Assistant Examiner*—Kimnhung Nguyen
(74) *Attorney, Agent, or Firm*—Oblon, Spivak, McCelland, Maier & Neustadt, P.C.

(57) ABSTRACT

Disclosed are an LCD power source control method and a control circuit thereof and an image forming apparatus having the control circuit. When a logic circuit voltage detecting circuit (voltage detecting means) detects a voltage drop of a power source of a power voltage +5V (logic circuit power source), a residual charge of a liquid crystal display (LCD) is forcibly discharged by an LCD power source control circuit (display voltage control means), whereby an LCD drive voltage can be caused to attenuate faster than the fall of the power source of the power voltage +5V (logic circuit power source) of a logic power source of the LCD, that is, a power source unit, therefore the liquid crystal display (LCD) will not be damaged.

34 Claims, 11 Drawing Sheets

LCD POWER SOURCE CONTROL METHOD AND CONTROL CIRCUIT THEREOF AND IMAGE FORMING APPARATUS HAVING THE CONTROL CIRCUIT

BACKGROUND OF THE INVENTION

1. Field of the Invention

The present invention relates to a drive power source of a liquid crystal display in an image forming apparatus, that is, an LCD power source control method for controlling a drive voltage and a control circuit thereof, and an image forming apparatus having the control circuit.

2. Description of the Prior Art

Hitherto, in an image forming apparatus of a copying machine or the like, for example, there is one in which fine toner particles are used to copy an image of an original document onto a copy paper.

According to this image forming apparatus, the image of the original document is optically read by an image reading device and then the read image is formed as an electrostatic latent image on a photoreceptor such as a photosensitive drum. Fine toner is adhered to the electrostatic latent image of the photoreceptor so that the image is formed (developed) by the toner.

Moreover, in the image forming apparatus, a sheet feed roller draws a copy paper from a paper tray or the like and the drawn copy paper is conveyed to a position of the photoreceptor by a number of sheet feed rollers, whereby the image formed on the photoreceptor is copied on the copy paper. The copy paper having the image copied thereon in such manner is transferred by the sheet feed roller to a portion of a fixed roller which will be heated by a heater. After being heated by the heat of the fixed roller, the copy paper is then discharged therefrom. The image transferred on the copy paper is fixed thereon due to heating.

Such an image reading device, a sheet feed roller, a photosensitive drum, fixed roller, and the like are operated by a power source circuit that is provided in a main body of the image forming apparatus.

Further, various operation buttons or switches are provided on an operation panel in such an image forming apparatus, and an LCD (liquid crystal display) for displaying the present situation of the apparatus and the displays corresponding to the operation is normally provided as display means therein as well.

A liquid crystal display such as an STN-LCD (Super Twisted Nematic Liquid Crystal Display) is often used for the operation panel. A drive voltage from a power source circuit is applied to a logic circuit, whereby operation control of a liquid crystal display such as the STN-LCD is performed based on a timing signal generated from the logic circuit. For example, a frame signal is used as the timing signal. A low voltage drive power source of a +5V system, a +3.3V system, or the like is necessary in order to control the operation of the logic circuit, and a drive power source of a relatively high voltage such as +24V or −12V is necessary for driving the liquid crystal display as well. It should be noted that, in order to discern the low voltage drive power source of the logic circuit from the drive power source for driving the liquid crystal display, the drive power source for driving the liquid crystal display is explained herein as a high voltage drive power source.

These drive power sources are provided in an LCD module, that is, inside the module of the liquid crystal display, whereby the drive voltage of the logic circuit and the liquid crystal display may be increased and generated inside the module.

Since the power source circuit for driving the image reading device and the movable parts such as the sheet feed roller, the photosensitive drum, and the fixed roller is disposed in the main body of the apparatus as mentioned above in the aforementioned image forming apparatus. The present situation is that a low voltage drive power source for the LCD module is provided in the power source circuit of the main body of the apparatus in order to reduce costs.

Further, it is necessary to set input and interruption timing of the power source of the main body of the apparatus as follows in the image forming apparatus in order to prevent deterioration of the liquid crystal of the liquid crystal display when performing input/interruption of the power source thereof. In other words, there is a demand that at the time of the power source input, the high voltage drive power source of the liquid crystal display rises at the same time as or later than the low voltage drive power source of the logic circuit. Also, at the interruption of the power source, it is demanded that the high voltage drive power source of the liquid crystal display falls earlier than or at the same time as the low voltage drive power source of the logic circuit.

However, in practice, it is difficult to fall the high voltage drive power source of the liquid crystal display faster than the low voltage drive power source of the logic circuit at the interruption of the power source. The reasons for this are enumerated as follows:

(1) Under the state in which the power source can be interrupted, because the drive of the image reading device, the motor, or the like for driving the movable parts such as the sheet feed roller, the photosensitive drum, and the fixed roller are not in operation, an amount of a consumed current of the power source circuit is small, and therefore the power source circuit is rendered into a stand-by mode;

(2) In addition, when the drive of the image reading device, the motor, or the like for driving the movable parts such as the sheet feed roller, the photosensitive drum, and the fired roller are in operation, power source capacity of the high voltage drive power source is made large so that ample power can be supplied to the motor or the like for driving the movable parts, and hence a voltage drop of the power source circuit at the time of power source interruption is slow; and (3) Still further, because the electricity consumed by the low voltage drive power source of the logic circuit during the stand-by mode is almost equivalent to that during operation, the voltage thereof drops relatively faster at the time of power interruption.

Regarding a drive voltage control device of a liquid crystal display, there is one disclosed in, for example, Japanese Patent Application Laid-open No. Heisei 11(1999)-282427. The drive voltage control device of the liquid crystal display disclosed in this publication has a control circuit as shown in FIG. 13.

As shown in FIG. 13, the drive voltage control device of the liquid crystal display has a power source circuit 1, which outputs voltages such as a stand-by voltage (+5VE) and a drive voltage (+24V), as well as switching means 2 inserted in a drive voltage supply line. A control voltage (+5V) thereof and the drive voltage (+24V) are to the applied to the liquid crystal display.

The drive voltage control device of the liquid crystal display includes timing control means (timing circuit) made up of a reset circuit 3, flip-flop circuits 4 and 5, an inverter 6, resistors 7 and 8, or the like.

According to this timing control means, the aforementioned switching means 2 is in a conductive state after the rise of the aforementioned control voltage (+5V) when changing to a power-saving mode OFF and when changing to a power-saving mode ON, the aforementioned switching means 2 is in a nonconductive state at the point where the aforementioned control voltage (+5V) starts to fall. The control voltage (+5V) and the drive voltage (+24V) are thus outputted when the power-saving mode is OFF. Further, when the power-saving mode is ON, output of the control voltage and the drive voltage are stopped. It should be noted that reference symbol 1*a* denotes a main power source switch and reference symbol 1*b* denotes a switch which will be shut when in the power-saving mode OFF.

According to this structure, the control voltage (+5V) is applied to the control circuit of the liquid crystal display (LCD) and the drive voltage (VEE=+24V) is applied to the liquid crystal display (LCD) after the control circuit starts operating. Therefore, when the power source circuit 1 is switched to the power-saving mode OFF, the liquid crystal display (LCD) is not damaged by the drive voltage (VEE=+24V). Further, the drive voltage (VEE=+24V) is quickly interrupted when the control voltage (+5V) starts to fall, whereby when switching to the power-saving mode ON, the drive voltage (VEE=+24V) is not maintained for a long time even after the operation of the control circuit stopped. As a result, the liquid crystal display (LCD) is not damaged.

However, in the drive voltage control device of the liquid crystal display such as the one shown in FIG. 13, the discharge of the residual charge inside the LCD during power source interruption is slow. Therefore, the fall of the LCD drive power source may possibly be delayed during power source interruption.

For example, when a relatively large number of capacitors are provided inside the LCD (liquid crystal display) for the purpose of enhancing the display quality thereof, the discharge of the residual charge inside the LCD (liquid crystal display) is delayed even though the supply of electricity to the LCD is cut off during power source interruption. As a result, the fall of the LCD drive power source may possibly be delayed accordingly. In this case, a problem of preventing the liquid crystal of the liquid crystal display from deteriorating during power source interruption of the LCD power source is still not solved.

SUMMARY OF THE INVENTION

The present invention has been made to solve such a problem, and therefore has an object to provide an LCD power source control method in which a residual charge inside a liquid crystal display during power source interruption can be positively removed and power source voltage supply/interruption of each of a logic circuit and a drive circuit can be performed in a correct order with a simply structured circuit, whereby deterioration of the liquid crystal display is minor. Further, the present invention has other objects to provide a control circuit and an image forming apparatus having the control circuit used in the LCD power source control method.

To achieve the above objects, in the LCD power source control method of the present invention, a voltage of a logic circuit power source in a module is detected by way of voltage detecting means to thereby perform supply/interruption of a voltage from an LCD drive power source to an LCD control circuit by means of LCD power source supply/interruption means. Meanwhile, the residual charge of the LCD drive circuit is forcibly discharged by means of compulsory discharge means when the LCD power source supply/interruption means is performing interruption. Further, in the LCD power source control method, upon detecting a voltage drop of the logic circuit power source, the voltage detecting means immediately outputs a signal indicating the voltage drop, whereby together with causing the LCD power source supply/interruption means to be in an interruption state, the compulsory discharge means is caused to be in an operation state to thereby control a discharge so that the residual charge of the LCD drive circuit is forcibly discharged by means of the compulsory discharge means before the voltage of the logic circuit power source becomes 0V.

According to the LCD power source control method, the compulsory discharge of the residual charge of the liquid crystal display can be instantly terminated in the period between times when the voltage detecting means detects the voltage drop of the logic circuit power source and when the circuit drive voltage becomes 0V.

According to this result, for example, even if a relatively large number of capacitors are provided inside the LCD (liquid crystal display) for the purpose of enhancing the display quality thereof, the discharge of the residual charge inside the LCD is performed instantaneously and forcibly when the supply of electricity to the LCD is interrupted at the time of power interruption. As a result, the fall of the LCD drive voltage (liquid crystal display drive voltage) is instantaneously performed so that the LCD drive voltage can become 0V before the logic circuit voltage becomes 0V. Therefore, the reverse flow of a current from the drive circuit of the liquid crystal display to the logic circuit when the operation of the liquid crystal display is OFF, that is, when the LCD power source supply/interruption means is performing interruption is prevented. The destruction of the logic circuit and the liquid crystal display when the operation of the liquid crystal display is OFF is thus prevented.

Further, in the LCD power source control method, upon detecting a voltage rise of the logic circuit power source, the voltage detecting means can be rendered to delay the output of a signal of the voltage rise for a fixed time until the voltage of the logic circuit power source becomes stable at a predetermined voltage, whereby together with causing the LCD power source supply/interruption means to a power supply state, the compulsory discharge means is caused to be in an open state.

According to the LCD power source control method, when the operation of the liquid crystal display is ON, that is, when the LCD power source supply/interruption means is supplying the power source, the reverse flow of a current from the drive circuit to the logic circuit of the liquid crystal display is prevented. The destruction of the logic circuit and the liquid crystal display when the operation of the liquid crystal display is ON is thus prevented.

Still further, the LCD power source control circuit implementing such a method includes: a plurality of power sources structured so that 2 power sources or more are supplied, having at least the logic circuit power source in a module and the LCD drive power source; voltage detecting means for detecting a voltage of the logic circuit power source; LCD power source supply/interruption means for performing supply/interruption of a voltage from the LCD drive power source to the LCD control circuit; and compulsory discharge means for forcibly discharging a residual charge of an LCD drive circuit when the LCD power source supply/interruption means is in interruption, wherein the voltage detecting means can be formed to have a structure in which the voltage detecting means immediately outputs a signal indicating a voltage drop upon detecting the voltage drop of the logic circuit power source, whereby together with causing the LCD power source supply/interruption means to be in the interruption state, the compulsory discharge means is caused to be in the operation state to thereby forcibly discharge the residual charge of the LCD drive circuit by means of the compulsory discharge means before the voltage of the logic circuit power source becomes 0V.

Further, upon detecting a voltage rise of the logic circuit power source, the voltage detecting means of the LCD power source control circuit delays the output of the signal indicating the voltage rise for a fixed time until the voltage of the logic circuit power source becomes stable at a predetermined voltage, whereby it is possible to control the LCD power source supply/interruption means to be in the power supply state, and the compulsory discharge means in the open state.

Further, the LCD power source control circuit can be structured to have discharge electric current restriction means provided therein to prevent a large current from flowing between the LCD power source supply/interruption means and the compulsory discharge means when both means are in operation at the same time. According to this structure, a maximum discharge electric current value flowing in the compulsory discharge means can be set in accordance with the amount of the residual charge of the liquid crystal display to be used because the discharge electric current restriction means is provided therein. In addition, protection of the compulsory discharge means can be performed. In other words, when the residual charge of the liquid crystal display is discharged by means of the compulsory discharge means, the discharge electric current restriction means restricts the current flowing in the compulsory discharge means so that the compulsory discharge means is not destroyed, whereby damage to the compulsory discharge means owing to the forced discharge of the residual charge can be prevented beforehand.

Still further, the LCD power source supply/interruption means can include a drive switching element connected to the LCD power source, which is switched to the interruption state due to a signal indicating that the voltage detecting means detects a voltage drop, and which is switched to a discharge state due to a signal indicating that the voltage detecting means detects a voltage rise. In addition, the compulsory discharge means can include a discharge switching element connected to earth, which is switched to the operating state due to a signal indicating that the voltage detecting means detects a voltage drop, and which is switched to the open state due to a signal indicating that the voltage detecting means detects a voltage rise.

According to this structure, the supply and interruption of the LCD power source to the LCD drive circuit can be performed with a simple structure, and the discharge of the residual charge of the LCD drive circuit can also be performed with a simple structure.

Further, the discharge electric current restriction means can be a resistor connected in series between the LCD power source supply/interruption means and the compulsory discharge means. According to this structure, a resistor for restricting a discharge electric current is provided therein, and therefore a resistance value is set in accordance with the amount of the residual charge of the liquid crystal display to be used, whereby a maximum discharge electric current value flowing in the compulsory discharge means can be simply and easily set. In addition, protection of the compulsory discharge means can be performed. In other words, when the residual charge of the liquid crystal display is discharged by means of the compulsory discharge means, the discharge electric current restriction resistor restricts the current flowing in the compulsory discharge means so that the compulsory discharge means is not destroyed, whereby damage to the compulsory discharge means owing to forced discharge of the residual charge can be prevented beforehand.

Still further, the LCD power source supply/interruption means can be formed of a first control switching element, which is connected to earth, and a plurality of resistors in addition to the drive switching element. According to this structure, ON/OFF control of the drive switching element can be easily performed by the first control switching element and the plurality of resistors.

Further, the compulsory discharge means can be provided with a second control switching element, which is connected to a control logic circuit power source, and a plurality of resistors in addition to the discharge switching element. According to this structure, the ON/OFF control of the discharge switching element can be easily performed by the second control switching element, which is connected to the control logic circuit power source, and the plurality of resistors.

Still further, the drive switching element, the discharge switching element, and the first and second switching elements can be transistors that have the above-mentioned respective characteristics.

Further, the discharge switching element can be a MOS FET also serving as the discharge electric current control resistor due to an internal resistor. According to this structure, when performing forced discharge of the residual charge of the liquid crystal display to be used, the maximum discharge electric current value flowing in the discharge MOS FET can be set in accordance with the amount of the residual charge of the liquid crystal display to be used by selecting the MOS FET which has an internal resistor that is not destroyed by the current flowing therein. In addition, protection of the discharge MOS FET can be conducted. Furthermore, means to forcibly discharge the residual charge of the liquid crystal display can be structured at a low cost. Moreover, the structure of the compulsory discharge means can be simplified by reducing one of the components compared with the one formed of the discharge switching element and the discharge electric current restriction means.

Further, the voltage detecting means can be set so that it judges that a voltage drop has been detected when a voltage VCC of the logic circuit power source becomes lower than a predetermined threshold value and judges that a voltage rise has been detected when the voltage VCC of the logic circuit power source becomes higher than the predetermined threshold value.

Further, the voltage detecting means can be set so that the signal indicating a voltage rise is not immediately outputted but delayed for a fixed time, whereby the signal is outputted after the voltage of the logic circuit power source is stable at a voltage of operation.

In this case, the reverse flow of a current from the drive circuit of the liquid crystal display to the logic circuit when the operation of the liquid crystal display is ON is prevented. As a result, the destruction of the logic circuit and the liquid crystal display when the operation of the liquid crystal display is ON is prevented.

Further, the voltage detecting means can be structured to share a reset circuit for resetting the logic circuit and control means thereof when the voltage detecting means has detected a voltage drop of the logic circuit power source and releasing the reset when a voltage rise has been detected so that the control means of the logic circuit does not go out of control.

Still further, a fax that has a copying function and a printing function or a copying machine (image forming apparatus) that has a data transmission function, a copying function, and a printing function can be structured to have the above-mentioned LCD power source control circuit.

DESCRIPTION OF THE PREFERRED EMBODIMENTS

Next, embodiment 1 of the present invention will be described with reference to the drawings.

[Structure]

FIGS. 1 to 8B are drawings illustrating the embodiment of the present invention.

Figure 1:
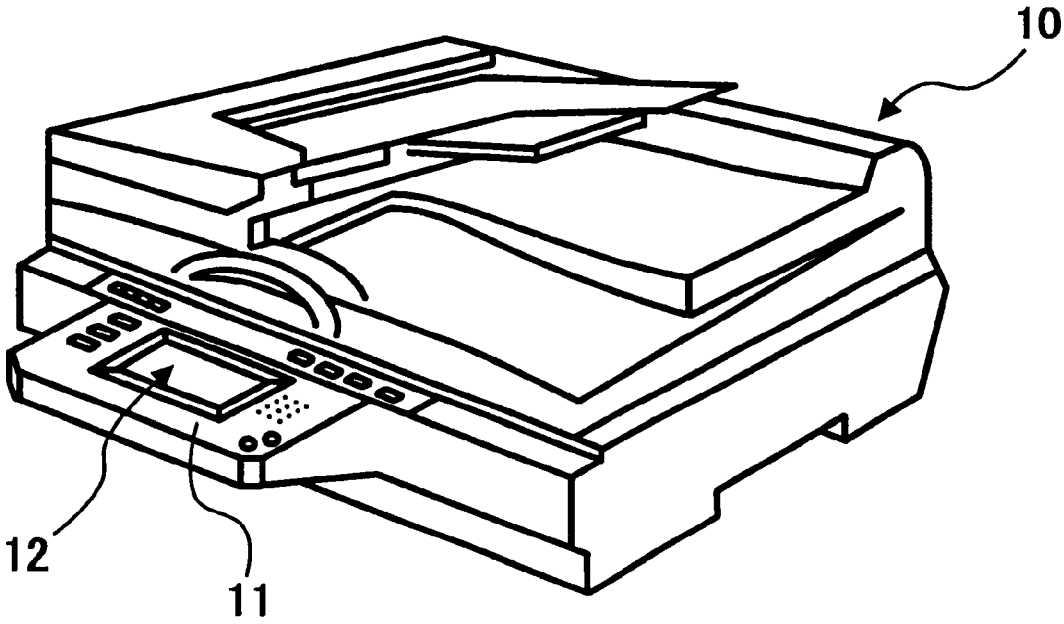
FIG. 1 is a perspective view showing an example of an image forming apparatus having an operation panel control circuit according to the present invention.

Referring to FIG. 1, reference numeral 10 denotes an image forming apparatus (composite machine) having multiple functions such as a FAX function and a printer function besides a copying function, and reference numeral 11 denotes an operation panel of the image forming apparatus 10.

Figure 2:
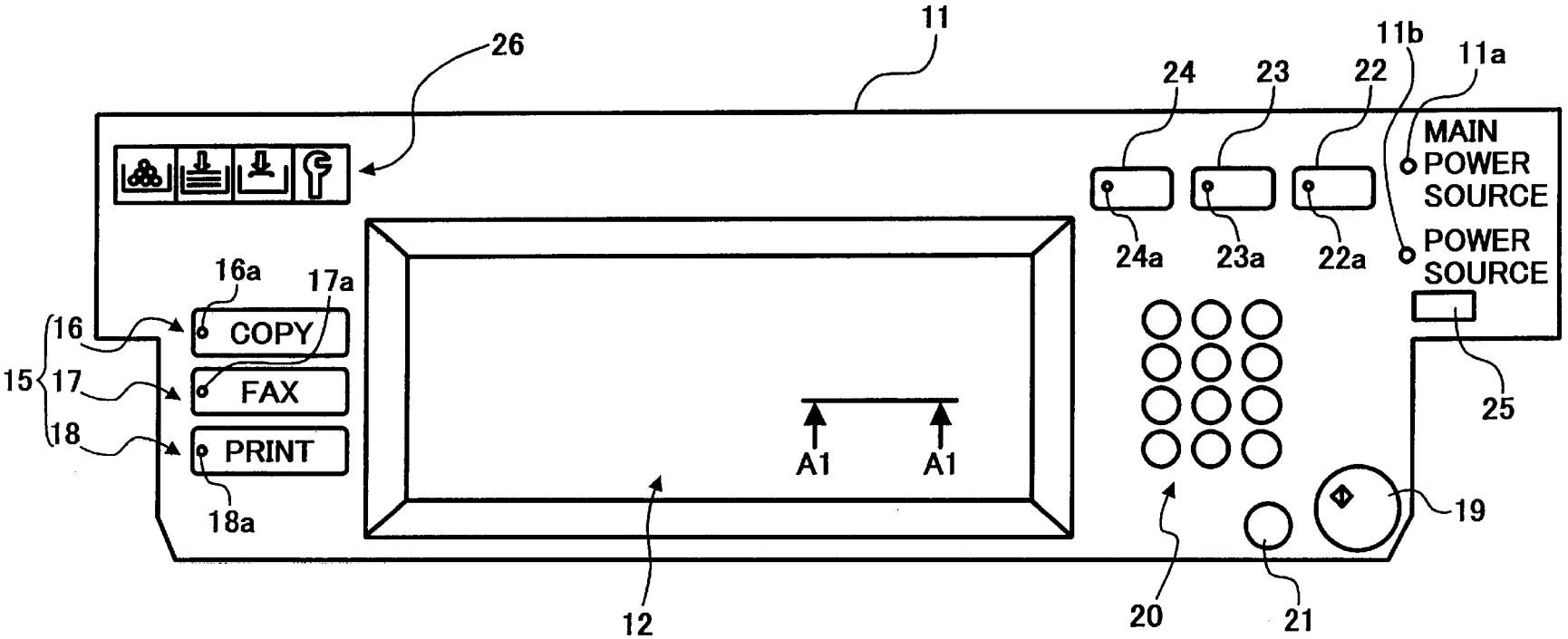
FIG. 2 is a plan view showing the operation panel shown in FIG. 1.
Figure 3:
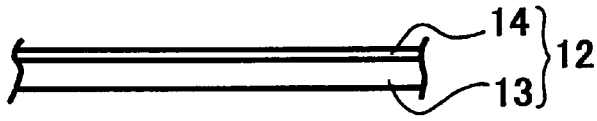
FIG. 3 is a sectional view taken along a line A1—A1 of FIG. 2.

Display means 12 is provided in the operation panel 11 as shown in FIG. 1 and FIG. 2. The display means 12 includes a liquid crystal display (LCD) 13, which is a display device, and a touch panel 14 attached to a surface of the liquid crystal display (LCD) 13 as shown in FIG. 3. In the display means 12, the images of key buttons with operation contents displayed therein are displayed on the liquid crystal display (LCD) 13 so that when portions corresponding to the key buttons of the touch panel 14 are touched, function settings and operations corresponding to the display of the key buttons can be performed. Complex function settings can thus be easily performed. A well-known structure can be adopted for the structure of the touch panel 14, and therefore detail explanations thereof will be omitted.

Further, the image forming apparatus 10 has other functions such as a FAX function and a printing function than a copy function as mentioned above. Switching means 15 including a [COPY] key 16, a [FAX] key 17, and a [PRINT] key 18 for switching from one application to another is provided in the operation panel 11. In each of the keys 16 to 18, LED16*a* to LED18*a* are provided, respectively, as display means to display and confirm the status of the switch being performed.

Provided in the operation panel 11 are: a start key 19 for starting a copy or the transmission of fax; a replacing key 20 for indicating the number of copies to be made or the other party of transmission; a clear/stop key 21 for clearing the replacing key and stopping the operation of making copies; an interruption key 22 for performing an interruption copy; a preheat key 23 for switching to and returning from the preheat mode; a program key 24 for holding/summoning an established copy mode, and the like. Furthermore, a hard key such as a power key 25 for switching to and returning from a minimum voltage stand-by mode. An alert display portion 26 or the like illuminated by LED for displaying various alerts such as toner end is further provided in the operation panel 11. LED 22*a* to LED 24*a* for displaying a switching status is provided as display means in the keys 22 to 24, respectively, and LED 11*a* and LED 11*b* as display means for a main power source display and a power source display are provided in the operation panel 11.

Figure 6:
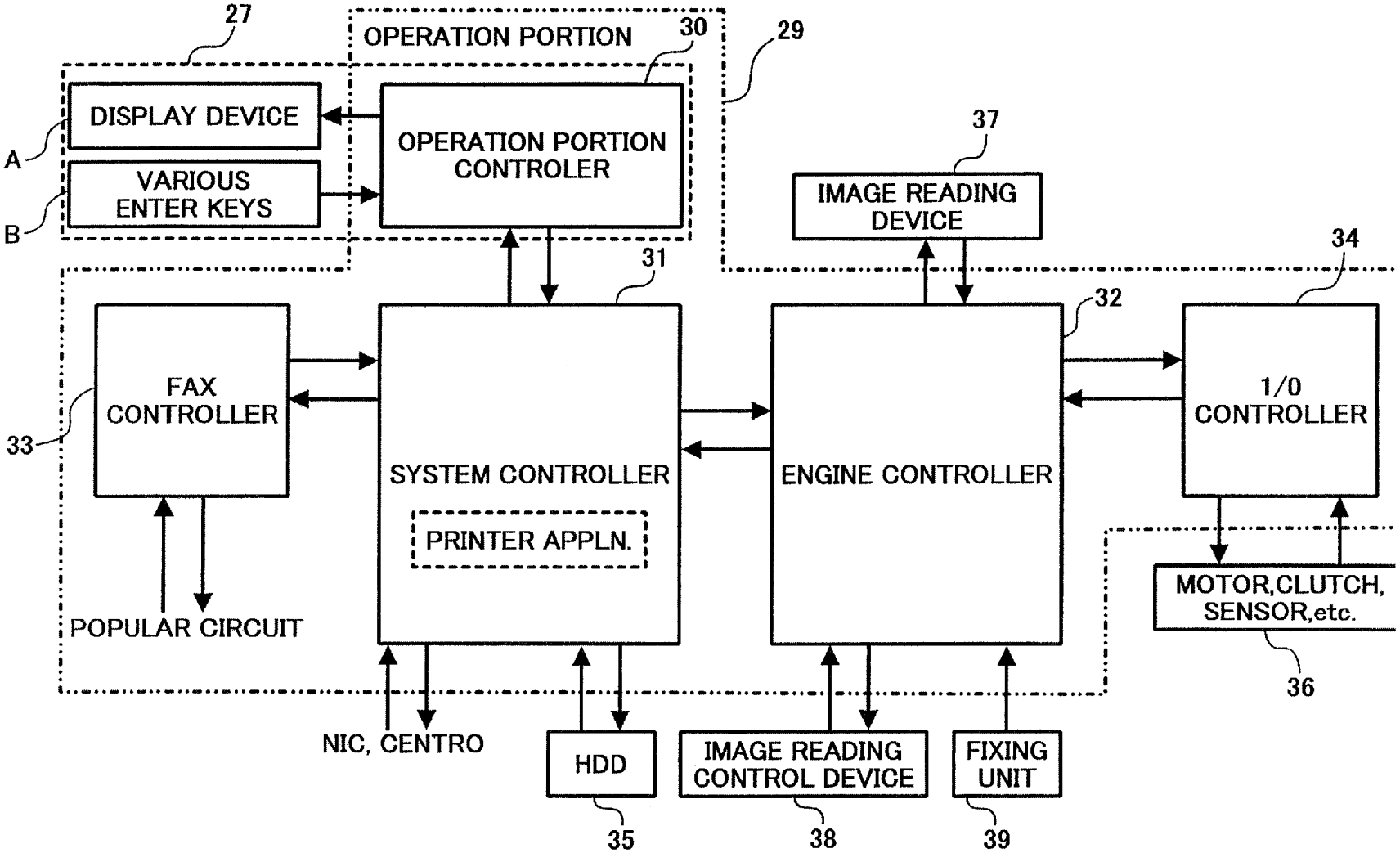
FIG. 6 is a detail view of the control circuit of FIG. 4.

It is to be noted that the LED 11*a*, LED 11*b*, LED16*a* to LED 18*a*, LED 22*a* to LED 24*a*, the alert display portion 26, liquid crystal display (LCD) 13, and the like provided in the operation panel 11 are a display device (display means) A shown in FIG. 6. Further, the touch panel 14, the keys 16 to 25, and the like are various enter keys (enter means) B shown in FIG. 6.

<Control Circuit>

Figure 4:
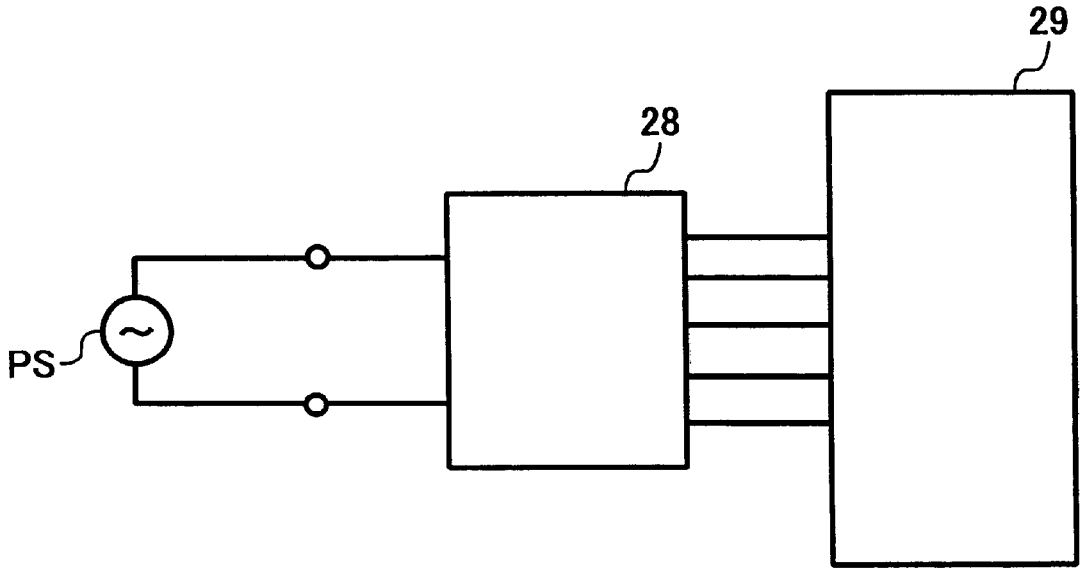
FIG. 4 is a schematic view showing a relation between a control circuit of the image forming apparatus and a power source circuit thereof according to the present invention.

As shown in FIG. 4, the image forming apparatus 10 including the operation panel 11 structured as the above has a power source unit (direct current power source) 28, which is connected to a commercial power source PS and supplies required electrical power to the entire apparatus, and a control circuit 29 operated by the power source unit 28. The power source unit 28 and the control circuit 29 forms one module incorporated in a circuit substrate not shown in the drawing.

Figure 5:
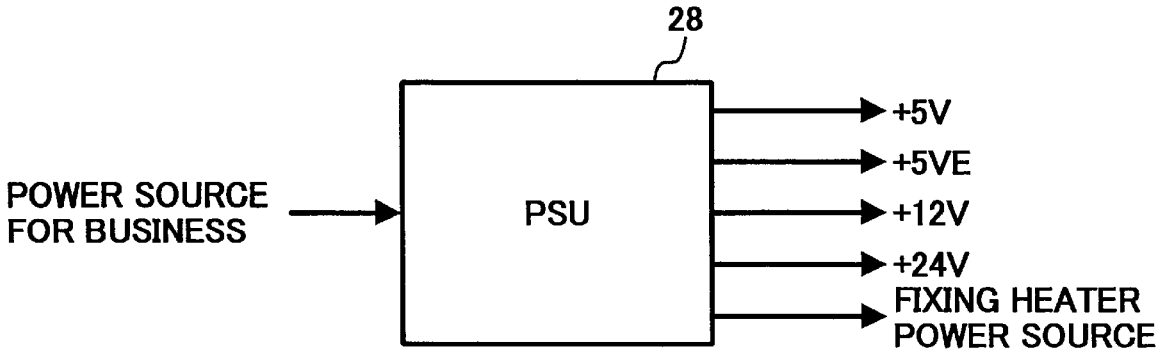
FIG. 5 is an explanatory view of the power source circuit (power source unit) of FIG. 4.

The power source unit 28 rectifies, smoothes, and lowers an alternating current (AC) from the commercial power source PS to thereby generate power sources such as various DC power sources used inside the apparatus and a heater power source for lighting up a heater of a fixing unit. For example, as shown in FIG. 5, the power source unit 28 rectifies, smoothes, and lowers an alternating current voltage from the commercial power source PS to thereby output direct current voltage +5V (VCC which will be explained later), +5VE, +12V, and +24V together with a fixing heater power source voltage. A power source of the direct current voltage +5V (VCC which will be explained later) of the power source unit 28 is employed as a logic circuit power source, and a power source of the drive voltage +24V of the power source unit 28 is employed as a display drive power source.

As shown in FIG. 6, the control circuit 29 includes an operation portion controller 30 which composes a part of an operation portion 27, a system controller 31 for performing various image processes, an engine controller 32 for performing operation control of the image forming device, a FAX controller 33 for performing control of the FAX application, and an I/O controller 34 for processing input signals from various sensors.

It is to be noted that the operation portion controller 30, the engine controller 32, the FAX controller 33, and the like are connected to the system controller 31. An external storage 35 such as a hard disk (HDD) for performing temporary storage of image data or the like is connected to the system controller 31. Further, in the system controller 31 given as an example, the printer application may be expanded by installing more internal program ROM. The image forming apparatus 10 may perform printer outputs via the system controller 31 by connecting the system controller 31 to a server or PC (personal computer) by way of an NIC (Network Interface Card) or Centronics I/F.

The I/O controller 34 is connected to the engine controller 32, and each of the portions of the image forming apparatus 10 such as a movable portion of a motor, a clutch, or the like and a detecting portion of sensors or the like are connected to the I/O controller 34 as an operating portion 36. The I/O controller 34 performs the drive control of the motor, clutch, or the like inside the machine and processes the input signals from various sensors.

Further, the engine controller 32 includes an image reading device 37, an image writing device 38, and an image fixing unit 39.

The image reading device 37 optically reads a document placed on a document holder not shown in the drawing. The image writing device 38 writes the image data read by the image reading device 37 to a photoreceptor not shown in the drawing to thereby form an electrostatic latent image. Fine toner particles are adhered to the electrostatic latent image of the photoreceptor to thereby develop the electrostatic latent image so that the image is formed on the photoreceptor by the toner. Then, the image formed by the toner on the photoreceptor is transferred to a copy paper and the copy paper with the image transferred thereon is conveyed to the image fixing unit 39 by means of a sheet feed roller not shown in the drawing. The image fixing unit 39 performs heating on the toner image on the copy paper to thereby fix the image thereon. A well-known structure can be adopted for the structure of such series of processes from reading an image to heat-fixing the image in order to form an image, and therefore the details thereof will be omitted. The aforementioned operation portion 27 will be described next using FIG. 6 and FIG. 7.

(Operation Portion 27)

Constituting the above-mentioned display device A and various enter keys B, the operation portion 27 also has the operation portion controller 30 as the logic circuit (drive voltage control circuit of the liquid crystal display (LCD) 13) for controlling the liquid crystal display (LCD) 13, that is, as an operation panel control circuit (display means control circuit). Note that the display device A is made up of the LED 11*a*, LED 11*b*, LED 16*a* to LED 18*a*, LED 22*a* to LED 24*a*, the alert display portion 26, the liquid crystal display (LCD) 13, and the like provided in the operation panel 11 as described above. The various enter keys B are the soft keys of the touch panel 14 or the like of the operation panel 11 and the hard key switches of the keys 16 to 25 or the like. The operation portion controller 30 processes information inputted from the display control of the display device A and various enter keys B.

Figure 7:
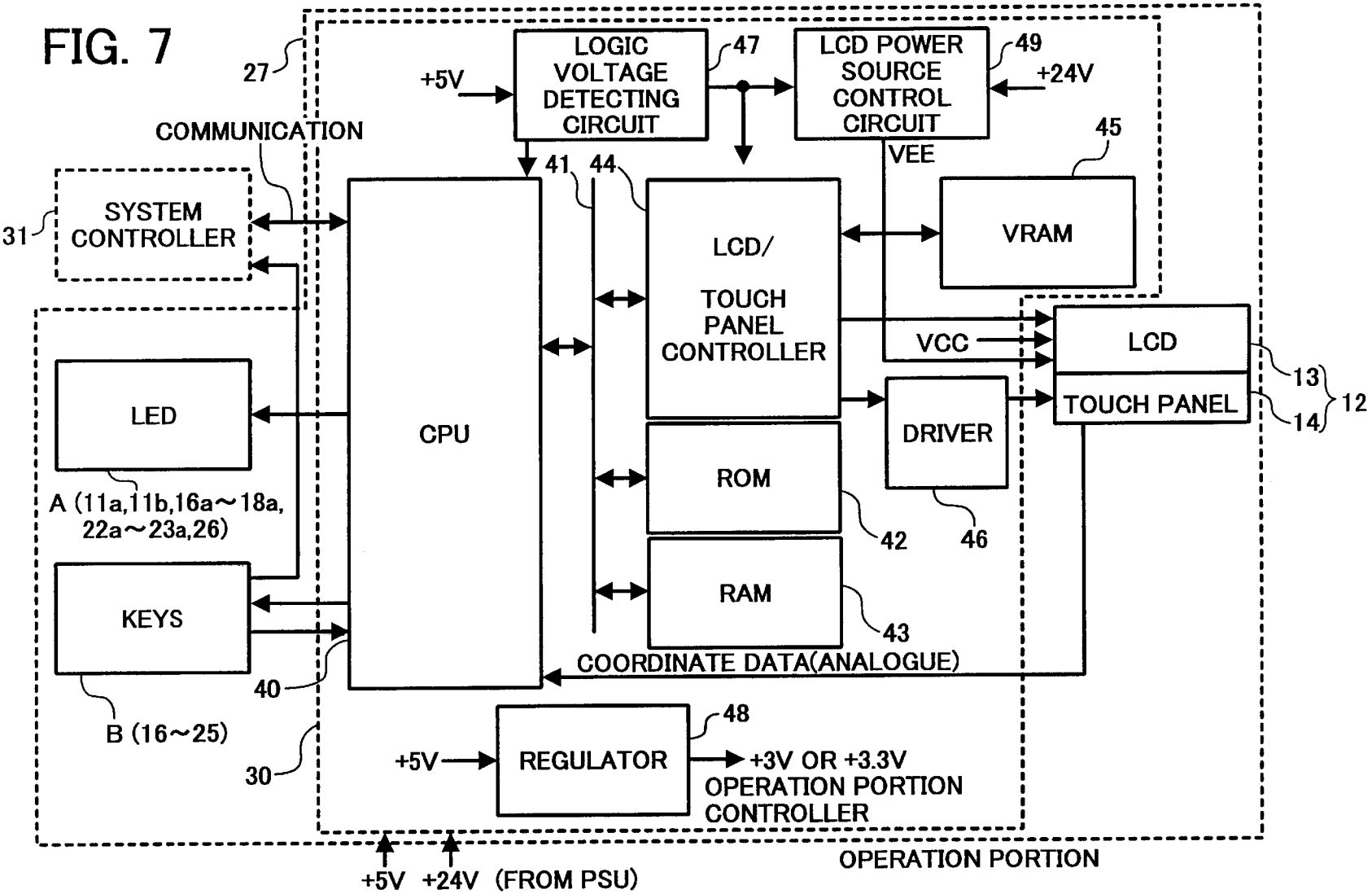
FIG. 7 is a detail view of the control circuit of the operation portion of FIG. 6.

As shown in FIG. 7, a CPU 40, which is a single chip micro (microcomputer), is utilized in the operation portion controller 30 for controlling as an arithmetic and control circuit (control means). The CPU 40 is connected to the system controller 31 by means of a built-in communications function. Furthermore, a ROM 42 for housing a control program and data, a work RAM 43 for performing temporary storage and process of processed data, and an LCD/touch panel controller 44 for controlling the drive of the touch panel 14 and the display control of the liquid crystal display (LCD) 13 are connected to a CPU bus 41.

A VRAM 45 for housing display data of the LCD is connected to the LCD/touch panel controller 44. The display data are successively read from the VRAM 45 and transmitted to the liquid crystal display (LCD) 13. An analog system is employed in the touch panel 14. The LCD/touch panel controller 44 has a port that outputs data for controlling the touch panel 14. Moreover, the LCD/touch panel controller 44 inputs port data outputted from the port to the touch panel 14 via a driver 46 so as to perform a bias control of the touch panel 14.

The aforementioned LED 11*a*, LED 11*b*, LED 16*a* to LED 18*a*, LED 22*a* to LED 24*a*, the alert display portion 26, and the like of the display device A are connected to a general port of the CPU 40. The CPU 40 controls the switching on of the display device A. Further, the soft keys of the touch panel 14 or the like and the keys 16 to 25 or the like of the various enter keys B are connected to the general port of the CPU 40, which conducts the process of input data from the various enter keys B.

The operation portion controller 30 serving as the logic circuit has a logic voltage detecting circuit 47 for detecting a power source voltage of the entire operation portion controller 30 as logic circuit voltage detecting means. The logic voltage detecting circuit 47 monitors the power source voltage of the operation portion controller 30 serving as the logic circuit so as to generate and supply a reset signal for initializing the CPU 40 and the LCD/touch panel controller 44. A reset circuit that has functions to detect a voltage of the logic circuit (operation portion controller 30 or LCD/touch panel controller 44) and prevent abnormal operation of the control means of the CPU 40 of the logic circuit (operation portion controller 30) caused by abnormal voltage can be employed in the logic voltage detecting circuit 47. A well-known reset circuit can be used as the reset circuit.

It should be noted that a direct current voltage +5V from a direct current power source +5V of the power source unit (PSU) 28 is applied to the CPU 40 and the LCD/touch panel controller 44. The logic voltage detecting circuit 47 then monitors (detects) the direct current voltage +5V.

In the case a power source of a 3V system is needed in the operation portion controller 30, a +3V or +3.3V voltage of this power source is often locally regulated by a regulator 48 and generated as 3V system. The reason for this resides in that in addition to the power source capacity of the 3V system being comparatively small, when the distance from the power source unit (PSU) 28 becomes longer, then voltage stability decreases. Therefore, the local regulator 48 is provided inside the operation portion controller 30 as described above, and the 3V system voltage is supplied from the regulator 48 to a portion in the operation portion controller 30 which needs the 3V system voltage, whereby the stability of the voltage to be supplied can be secured.

Further, a power source of the voltage +5V of the power source unit (PSU) 28 is often directly used as a logic power source of the liquid crystal display (LCD) 13. In other words, the voltage +5V of the power source unit (PSU) 28 is frequently applied directly to the logic circuit of the liquid crystal display (LCD) 13 as an operation voltage (control voltage).

However, in the present embodiment, a logic power source (VCC) used for the logic circuit of the liquid crystal display (LCD) 13 is the same as the power source used for the power source of the LCD/touch panel controller 44. In other words, the voltage of +5V of the power source unit (PSU) 28 is applied to the LCD/touch panel controller 44, whereby an operation voltage (control voltage) from the LCD/touch panel controller 44 is fed to the liquid crystal display (LCD) 13 as an operation signal (control signal), i.e., a timing signal.

The operation voltage applied to the liquid crystal display (LCD) 13 in such manner is supplied from the power source unit (PSU) 28. Note that the voltage of the 3V system from the power source of the 3V system of the regulator 48 may be applied to the logic circuit inside the liquid crystal display (LCD) 13.

<LCD Power Source Control Circuit (LCD Voltage Control Circuit)>

The operation portion controller 30 has an LCD power source control circuit (LCD voltage control circuit) 49 as display voltage control means. And, the voltage +24V of the power source unit 28 is applied to the liquid crystal display (LCD) 13 as a drive voltage via the LCD power source control circuit 49. The LCD power source control circuit 49 will be further described in detail in the following.

Figure 8A:
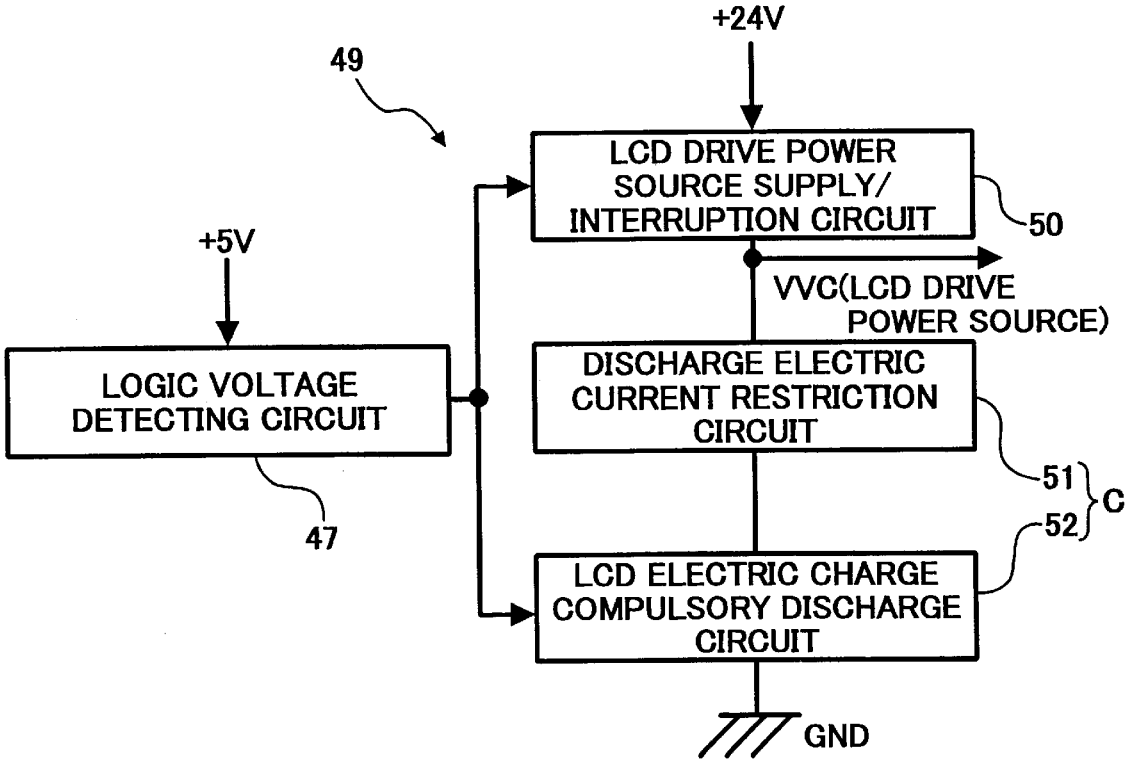
FIG. 8A is a further detail circuit diagram of the LCD power source control circuit of FIG. 7.
Figure 8B:
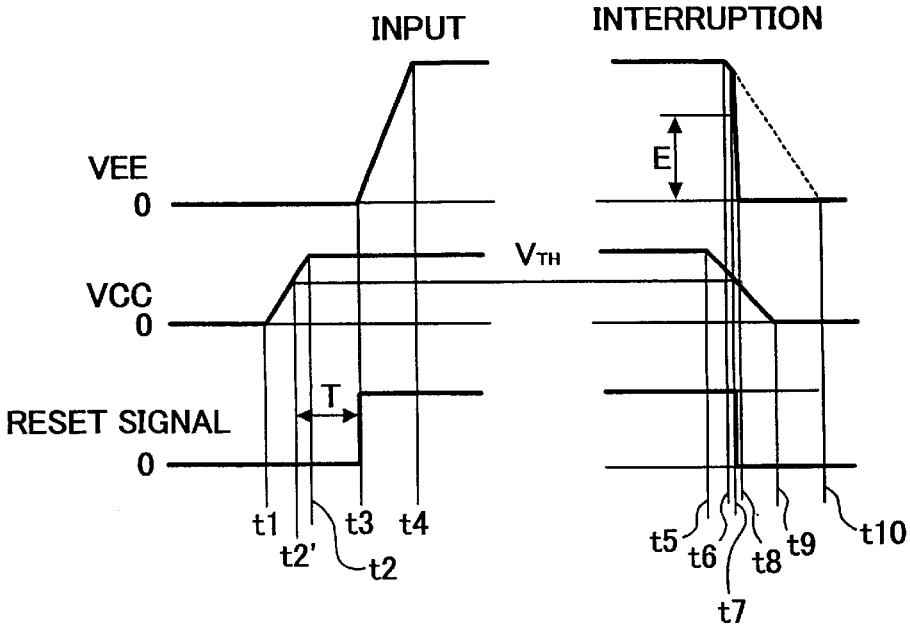
FIG. 8B is a time chart for explaining an operation of the LCD power source control circuit of FIG. 8A.

As shown in FIG. 8A, the LCD power source control circuit 49 includes an LCD drive power source supply/interruption circuit (LCD drive voltage supply/interruption means) 50 serving as LCD drive voltage interruption means, and LCD electric charge compulsory discharge means (LCD residual charge compulsory discharge means) C. Further, the LCD electric charge compulsory discharge means C includes a discharge electric current restriction circuit 51 as discharge electric current restriction means and an LCD electric charge compulsory discharge circuit 52 as substantial LCD residual charge discharge means.

On the input side of the LCD drive power source supply/interruption circuit 50 for controlling the LCD drive voltage, the voltage +24V of the power source unit 28 is applied thereto. The output side of the LCD drive power source supply/interruption circuit 50 is connected to a drive circuit (not shown) of the liquid crystal display (LCD) 13 and earthed as well via the discharge electric current restriction circuit 51 and the LCD electric charge compulsory discharge circuit 52. By forming such a structure, a large penetrating current is prevented from flowing between the LCD drive power source and the earth GND at a time in which the LCD drive power source supply/interruption circuit 50 and the LCD electric charge compulsory discharge circuit 52 are both changed to thereby prevent the liquid crystal display (LCD) 13, the power source control circuit 49, and the like from deteriorating.

A reset IC (reset circuit), for example, is employed as the logic voltage detecting circuit 47 in the present embodiment, however, it does not necessarily have to be a reset IC. In the present embodiment, a reset signal "L" or "H" is outputted from the logic voltage detecting circuit 47 as a logic voltage detecting signal. The logic voltage detecting signal is fed to a control signal input side of the LCD drive power source supply/interruption circuit 50 and to a control signal input side of the LCD electric charge compulsory discharge circuit 52.

The voltage +24V of the power source unit 28 is applied to the circuit (not shown) of the liquid crystal display (LCD) 13 as a drive voltage VEE via the LCD drive power source supply/interruption circuit 50 when the LCD drive power source supply/interruption circuit 50 is ON. In other words, the LCD drive power source supply/interruption circuit 50 is rendered ON when the reset signal from the logic voltage detecting circuit 47 becomes "H" and outputs the voltage +24V as the drive voltage VEE. The drive voltage VEE is then applied to the circuit (not shown) of the liquid crystal display (LCD) 13.

Further, when the LCD drive power source supply/interruption circuit 50 is OFF, the drive voltage VEE fed to the drive circuit (not shown) of the liquid crystal display (LCD) 13 via the LCD drive power source supply/interruption circuit 50 is caused to be interrupted. In other words, the LCD drive power source supply/interruption circuit 50 is rendered OFF when the reset signal from the logic voltage detecting circuit 47 becomes "L" and stops the output of the drive voltage VEE, thereby interrupting the drive voltage VEE applied to the drive circuit (not shown) of the liquid crystal display (LCD) 13.

The LCD electric charge compulsory discharge circuit 52 is rendered ON when the reset signal from the logic voltage detecting circuit 47 becomes "L" and forcibly discharge the residual charge of the drive voltage VEE, that is, the residual charge of the drive circuit (not shown) of the liquid crystal display (LCD) 13 via the discharge electric current restriction circuit 51. Also, when the reset signal from the logic voltage detecting circuit 47 becomes "H", the LCD electric charge compulsory discharge circuit 52 for controlling the LCD drive voltage is rendered OFF, whereby the drive voltage VEE is applied normally to the circuit of the liquid crystal display (LCD) 13 not shown in the drawing.

Besides, provision is made so that when the discharge electric current restriction circuit 51 forcibly discharges the residual charge created by the drive voltage VEE, the penetrating current is caused to be lower than an electric current value permissible to the LCD electric charge compulsory discharge circuit 52, and even in the case when both the LCD drive power source supply/interruption circuit 50 and the LCD electric charge compulsory discharge circuit 52 are rendered ON simultaneously at a timing in which the reset signal switches from "H" to "L", the penetrating current is caused to be lower than the electric current value of both circuits so as not to destroy both circuits 50 and 52.

[Operation]

The voltage control of the liquid crystal display (LCD) 13 associated with the ON/OFF power source of the image forming apparatus 10 having such a structure is described next.

(i) OFF State of the Liquid Crystal Display (LCD) 13

In such a structure, each time the press-touch operation (ON operation) of the power key (power switch) 25 for switching to and returning from a low power stand-by mode is repeated, the ON operation thereof is inputted to the system controller 31. When an ON signal of the power key 25 is reciprocally fed to the system controller 31, the system controller 31 reciprocally repeats control of switching to and returning from the low power stand-by mode.

Then, under the state when switching to the low power stand-by mode, the engine controller 32 and the fax controller 33 are switched to the low power stand-by mode by the system controller 31.

Besides, under the low power stand-by mode, the system controller 31 turns off the power source supplied to the operation portion controller (logic circuit) 30.

(ii) ON Operation of the Liquid Crystal Display (LCD) 13 Due to the Operation of the Power Key 25

From the OFF state of the display of the liquid crystal display (LCD) 13, that is, from the stand-by mode of the liquid crystal display (LCD) 13, when the aforementioned power switch 25 is press-touched, an ON signal from the power switch 25 is fed to the system controller 31, whereby the engine controller 32, the fax controller 33, and the like are caused to return from the stand-by mode by the system controller 31.

Together with the return from the stand-by mode, the system controller 31 starts the supply of power source from the power source unit 28 to the operation portion controller 30.

Figure 10:
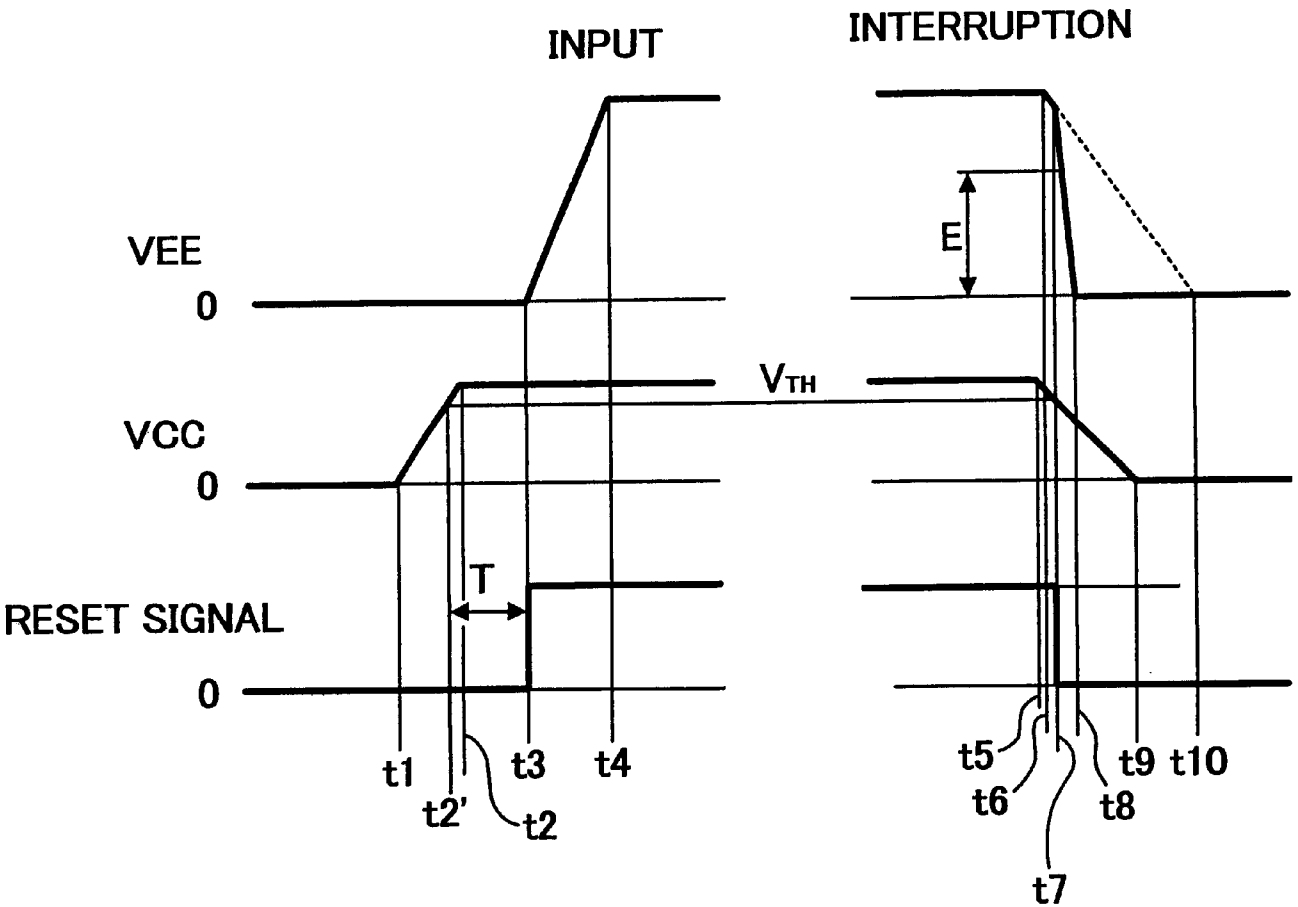
FIG. 10 is a time chart for explaining an operation according to the circuit diagram of FIG. 9.

At this point, the power source voltage VCC applied to the LCD/touch panel controller 44 gradually rises (increase voltage) from a time t1 and becomes a maximum voltage at a time t2 as shown in FIG. 10.

The logic voltage detecting circuit 47 detects a voltage VTH as a reference voltage (logic circuit voltage, threshold voltage, namely, setting voltage) at a time t2' which is the time immediately before the time t2 at which the voltage VCC applied to the circuit of the LCD/touch panel controller 44 becomes a maximum voltage. The reference voltage is, for example, set to about 80% of the maximum of the power source voltage VCC in the present embodiment. It is to be noted that the reset signal outputted from the logic voltage detecting circuit 47 is set to "L" until the voltage VCC applied to the LCD/touch panel controller 44 becomes a maximum voltage at the time t2 and is stable as well. That is to say, the reset signal is set to "L" from the time the logic voltage detecting circuit 47 detects the reference voltage VTH at the time t2' until only a fixed period (time) T elapses.

Then, at the time from the detection of the reference voltage VTH at the time t2' to the elapse of only the fixed period (time) T, the logic voltage detecting circuit 47 switches the reset signal from "L" to "H" at a time t3 (t3>t2>t2') and outputs the switched reset signal "H" as a logic circuit voltage detecting signal. The reset signal "H" is then fed to the LCD/touch panel controller 44. Upon input of the reset signal "H", the LCD/touch panel controller 44 outputs a timing signal to the liquid crystal display (LCD) 13. Thus, until the point at which the logic circuit voltage VCC is completely stable, the logic voltage detecting circuit 47 switches the reset signal from "L" to "H" at a delay of T time and outputs the reset signal.

Meanwhile, the reset signal "H" is fed to the LCD drive power source supply/interruption circuit 50 and the LCD electric charge compulsory discharge circuit 52 at the time t3.

The LCD drive power source supply/interruption circuit 50 is rendered ON when the reset signal from the logic voltage detecting circuit 47 turns to "H" at a time t3, and outputs the +24V as a drive voltage VEE to thereby apply the drive voltage VEE to the drive circuit (not shown) of the liquid crystal display (LCD) 13. Further, the LCD electric charge compulsory discharge circuit 52 is rendered OFF when the reset signal from the logic voltage detecting circuit 47 turns to "H" at the time t3 so as to normally apply the drive voltage VEE to the drive circuit (not shown) of the liquid crystal display (LCD) 13. The drive voltage VEE increases (increase voltage) from the time t3 and becomes a maximum +24V at a time t4.

Accordingly, the liquid crystal display (LCD) 13, having its operation controlled by the timing signal of a frame signal or the like from the LCD/touch panel controller 44, displays the present setting conditions and the controlled state of the respective portions or the like of the image forming apparatus 10.

The drive voltage VEE is thus applied to the drive circuit (not shown) of the liquid crystal display (LCD) 13 from the time t3, which is later than the time t2 at which the circuit voltage (voltage for the logic circuit) VCC reaches maximum (stable). Therefore, a current from the drive circuit of the liquid crystal display (LCD) 13 is prevented from flowing back to the logic circuits of the operation portion controller 30 or the like including the LCD/touch panel controller 44 at the time of starting the operation of the liquid crystal display (LCD) 13, whereby deterioration of the logic circuits and the liquid crystal display (LCD) 13 at the operation starting time of the liquid crystal display (LCD) 13 is prevented.

(iii) OFF Operation of the Liquid Crystal Display (LCD) 13 Due to the Operation of the Power Key 25

In addition, when the power key 25 is operated ON at a time t5 under the state in which the liquid crystal display (LCD) 13 is turned ON and displaying the present setting conditions and the controlled state of the respective portions of the image forming apparatus 10, the ON operation of the power key 25 is inputted to the system controller 31.

Upon input of an ON signal from the power key 25 at the time t5, controllers such as the engine controller 32 and the fax controller 33 are switched to the stand-by mode by the system controller 31.

Meanwhile upon input of the ON signal from the power key 25 at the time t5, the system controller 31 controls the operation of the CPU 40 to thereby turn OFF the voltage VCC that is applied to the LCD/touch panel controller 44. Application of the drive power source +24V to the liquid crystal display (LCD) 13 is thus turned OFF at a time t6. At this time, the voltage VCC of the LCD/touch panel controller 44 starts to drop from the time t5 towards a time t9 (decrease voltage). In addition, the voltage of the power source +24V starts to drop from the time t6 towards a time t10.

Next, the logic voltage detecting circuit 47, upon detecting the reference voltage VTH at a time t7, immediately outputs the reset signal "L" at the time t7 as the logic voltage detecting signal and inputs the reset signal "L" to the LCD/touch panel controller 44.

Upon input of the reset signal "L", the LCD/touch panel controller 44 stops the output of the timing signal, thereby suspending the display control of the liquid crystal display (LCD) 13.

Meanwhile the reset signal "L" is fed to the LCD drive power source supply/interruption circuit 50 and the LCD electric charge compulsory discharge circuit 52 at the time t7.

The LCD drive power source supply/interruption circuit 50 is immediately rendered OFF once the reset signal from the logic voltage detecting circuit 47 turns to "L" at the time t7 to thereby interrupt the drive voltage VEE (+24V) applied as the drive voltage VEE to the drive circuit (not shown) of the liquid crystal display (LCD) 13 at the time t7. At the same time, the LCD electric charge compulsory discharge circuit 52 is rendered ON when the reset signal from the logic voltage detecting circuit 47 turns to "L" at the time t7 to thereby forcibly discharge the residual charge of the drive voltage VEE, in other words, to forcibly discharge the residual charge of the drive circuit (not shown) of the liquid crystal display (LCD) 13 via the discharge electric current restriction circuit 51. At this point, though the voltage VCC of the LCD/touch panel controller 44 becomes 0V at the time t9, forced discharge is precipitately performed so that the residual charge of the drive voltage VEE can become 0V at the time t8 much earlier than the time t9. Therefore, the reverse flow of a current from the liquid crystal display (LCD) 13 to the logic circuits of the operation portion controller 30 including the LCD/touch panel controller 44 when the drive voltage of the liquid crystal display (LCD) 13 is OFF is prevented, whereby deterioration of the logic circuits and the liquid crystal display (LCD) 13 when the liquid crystal display (LCD) 13 is turned OFF is prevented.

Further, when performing forced discharge, the discharge electric current restriction circuit 51 restricts the discharge current so that it becomes lower than the electric current value permissible to the LCD electric charge compulsory discharge circuit 52. Even in the case when both the LCD drive power source supply/interruption circuit 50 and the LCD electric charge compulsory discharge circuit 52 are rendered ON simultaneously at a timing when the reset signal is switched from "H" to "L", the discharge electric current restriction circuit 51 restricts the penetrating current causing the current value thereof to be lower than the permissible electric current value of both circuits so as not to destroy both circuits 50 and 52.

(iv) Thus, the LCD voltage control circuit includes the power source +24V (display drive power source) of the power source unit 28 for applying the display drive voltage to the liquid crystal display (LCD) 13, the operation portion controller (logic circuit) 30 for controlling the operation of the liquid crystal display (LCD) 13, the power source of the voltage +5V (logic circuit power source) of the power source unit 28 for applying the circuit drive voltage to the operation portion controller 30, and the logic circuit voltage detecting circuit (voltage detecting means) 47 for detecting the circuit drive voltage applied to the operation portion controller 30.

In addition to the structure, the LCD voltage control circuit includes the LCD drive power source supply/interruption circuit (drive voltage supply/interruption means) 50 which is operated by a detected voltage from the logic circuit voltage detecting circuit 47.

Moreover, the LCD drive power source supply/interruption circuit (drive voltage supply/interruption means) 50 can be controlled so that it is in the interruption state from the time the logic circuit voltage detecting circuit 47 detects a voltage rise of the circuit drive voltage VCC of the power source of the voltage +5V (logic circuit power source) of the power source unit 28 (power source for the logic circuit) during the ON operation thereof until the circuit drive voltage VCC becomes stable as described above without applying the drive voltage from the power source of +24V (display drive power source) of the power source unit 28 to the liquid crystal display (LCD) 13. Next, the LCD drive power source supply/interruption circuit (drive voltage supply/interruption means) 50 can be controlled to start operating at the point in which the logic circuit voltage VCC rises and becomes stable to thereby apply the drive voltage from the power source of +24V (display drive power source) of the power source unit 28 to the liquid crystal display (LCD) 13. Therefore, through such control, the reverse flow of a current from the LCD drive circuit of the liquid crystal display (LCD) 13 to the logic circuit of the operation portion controller 30 including from the liquid crystal display (LCD) 13 to the LCD/touch panel controller 44 at the time of starting the operation of the liquid crystal display (LCD) 13 can be prevented, whereby deterioration of the logic circuits and the liquid crystal display (LCD) 13 at the operation start time of the liquid crystal display (LCD) 13 is prevented.

The LCD drive power source supply/interruption circuit (drive voltage supply/interruption means) 50 can be controlled so that the display drive voltage from the power source of +24V (display drive power source) of the power source unit 28 applied to the liquid crystal display (LCD) 13 is interrupted once the logic circuit voltage detecting circuit 47 detects a voltage drop of the circuit drive voltage during the OFF operation of the power source of the voltage +5V (logic circuit power source) of the power source unit 28 (logic circuit power source) as described above.

Still further, when the logic circuit voltage detecting circuit (voltage detecting means) 47 detects the voltage drop of the power source of the power voltage +5V (logic circuit power source), the structure of the LCD control circuit can be formed to constitute the LCD electric charge compulsory discharge means C which forcibly discharges the residual charge of the liquid crystal display (LCD) 13.

Accordingly, the LCD drive voltage can be caused to attenuate faster than the fall of the power source of the power voltage +5V of the power source unit 28 (logic circuit power source), that is, the logic power source of the LCD, and therefore the liquid crystal display (LCD) 13 will not be damaged.

By forming the structure as the above, when the logic circuit voltage detecting circuit (voltage detecting means) 47 detects the voltage drop of the power source of the power voltage +5V (logic circuit power source), the LCD electric charge compulsory discharge means C forcibly starts the discharge of the residual charge of the liquid crystal display (LCD) 13, and from the time when the logic circuit voltage detecting circuit (voltage detecting means) 47 detects the voltage drop of the power source of the power voltage +5V (logic circuit power source) to the time before the circuit drive voltage VCC becomes 0V, the LCD electric charge compulsory discharge means C forcibly terminates the discharge of the residual charges instantaneously so that the display drive voltage becomes almost 0V. Therefore, the reverse flow of a current from the liquid crystal display (LCD) 13 to the logic circuit of the operation portion controller 30 including the LCD/touch panel controller 44 when the drive voltage of the liquid crystal display (LCD) 13 is OFF is prevented, whereby deterioration of the logic circuits and the liquid crystal display (LCD) 13 when the liquid crystal display (LCD) 13 is turned OFF is prevented.

Though the drive voltage interruption means operates in a manner that the application of the display drive voltage to the liquid crystal display from the display drive power source is carried out after the voltage detecting means has detected the voltage rise of the circuit drive voltage when it is ON, the operation is not limited thereto. For example, the drive voltage interruption means may operate so that the display drive voltage from the display drive power source is applied to the liquid crystal display at the point when the voltage detecting means detects the voltage rise of the circuit drive voltage when the voltage is ON.

Embodiment 1

Figure 9:
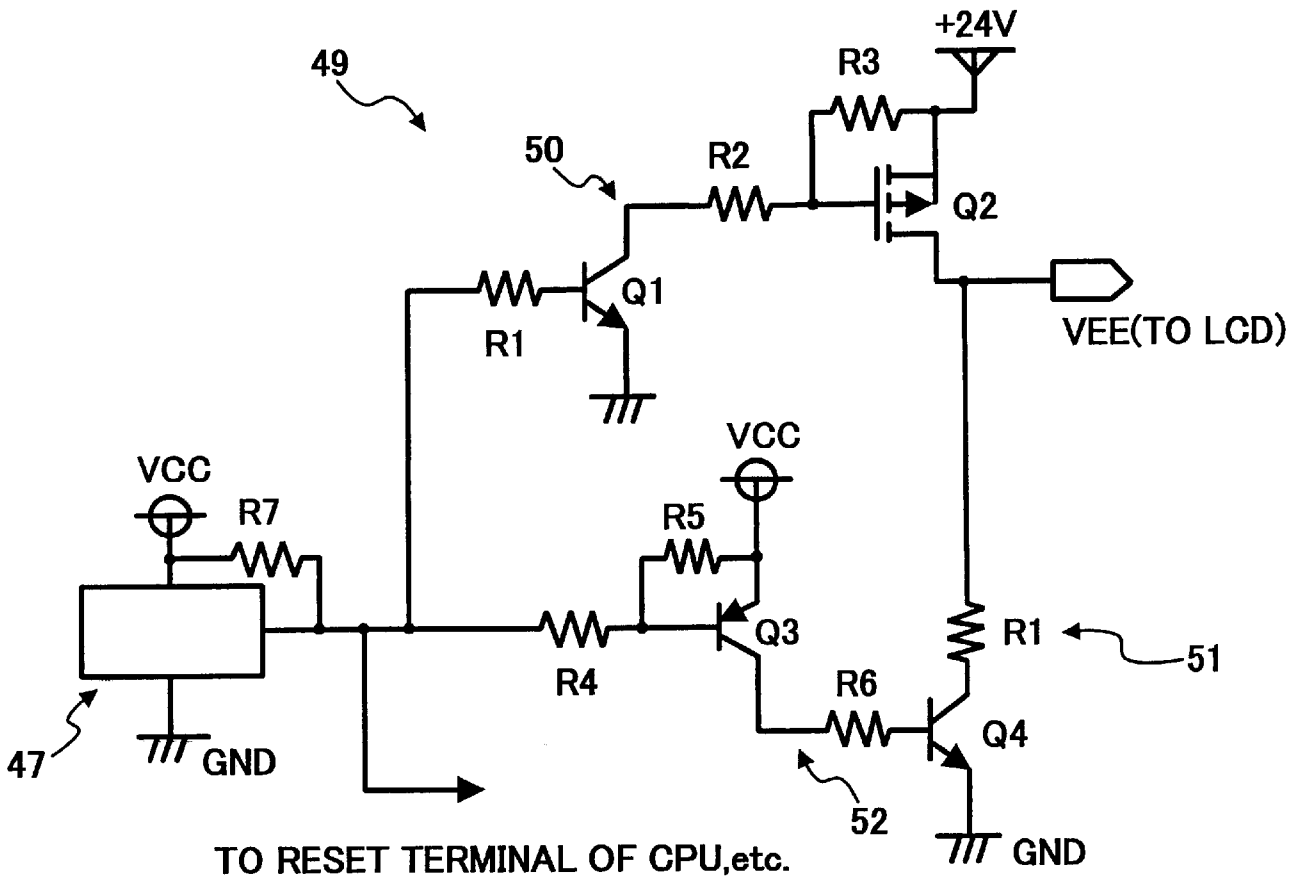
FIG. 9 is a further detail circuit diagram of the circuit diagram of FIG. 8A.

The LCD power source control circuit 49 shown in FIG. 8A can, also be formed to have a structure as shown in FIG. 9. That is to say, the LCD drive power source supply/interruption circuit (LCD drive voltage supply/interruption means) 50 serving as the LCD drive voltage supply/interruption means, the discharge electric current restriction circuit 51 as the discharge electric current restriction means, the LCD electric charge compulsory discharge circuit 52 as the LCD drive voltage discharge means, and the like of FIG. 8A can be structured as shown in FIG. 9.

As shown in FIG. 9, the LCD drive power source supply/interruption circuit 50 includes a transistor Q1 as a first switching element of the drive voltage interruption (for drive voltage control) and a MOS FET Q2 (hereinafter simply abbreviated as FET Q2) as a second switching element (transistor) of the drive voltage interruption (for drive voltage control). At a base of the transistor Q1, the logic voltage detecting signal indicating that the logic voltage detecting circuit 47 is inputted therein via a resistor R1. An emitter of the transistor Q1 is earthed. Further, a collector of the transistor Q1 is connected to a gate of the FET Q2 via a resistor R2 and a source of FET Q2 is connected to a gate of the FET Q2 via a resistor R3. It is to be noted that the above-mentioned power source voltage VCC (+5V) of the power source unit (PSU) 28 is applied to the logic voltage detecting circuit 47.

Moreover, the power source voltage (+24V) of the power source unit (PSU) 28 is applied to the source of the FET Q2, and the voltage VEE is outputted from the drain of the FET Q2. The voltage VEE is fed to the liquid crystal display (LCD) 13 as the drive voltage.

The LCD electric charge compulsory discharge circuit 52 includes transistors Q3 and Q4 as the first and second switching elements, respectively, for discharging a residual charge (for controlling a drive voltage). At a base of the transistor Q3, the logic voltage detecting signal of the logic voltage detecting circuit 47 is inputted therein via a resistor R4. An emitter of the transistor Q3 is connected to the base of the transistor Q3 via a resistor R5. The above-mentioned power source voltage VCC (+5V) of the power source unit (PSU) 28 is applied to the emitter of the transistor Q3 and to the base of the transistor Q3 via the resistor R5.

Further, a collector of the transistor Q3 is connected to a base of the transistor Q4 via the resistor R6, the drain of the FET Q2 is connected to a collector of the transistor Q4 via a resistor RL serving as a discharge electric current restriction resistor (discharge electric current restriction means). Meanwhile, an emitter of the transistor Q4 is earthed.

It is to be noted that the power source voltage VCC (+5V) of the power source unit (PSU) 28 is applied to the base of the transistors Q1 and Q3 via the resistors R1 and R4, respectively, by way of a resistor R7. In addition, a reset terminal of the CPU 40 and the LCD/touch panel controller 44 are connected between the resistors R1, R4 and the resistor R7.

The operation of the LCD power source control circuit 49 having such a structure will be described next.

(i) OFF State of the Liquid Crystal Display (LCD) 13

In such a structure, each time the press-touch operation (ON operation) of the power key (power switch) 25 for switching to and returning from a low power stand-by mode is repeated, the ON operation thereof is inputted to the system controller 31. When the ON signal of the power key 25 is reciprocally fed to the system controller 31, the system controller 31 reciprocally repeats control of switching to and returning from the low power stand-by mode.

Then, under the state when switched to the low power stand-by mode, the engine controller 32 and the fax controller 33 are switched to the low power stand-by mode by the system controller 31.

In addition, under the low power stand-by mode, the system controller 31 turns off the operation portion controller (logic circuit) 30, so that a timing signal for controlling the drive of the liquid crystal display (LCD) 13 is not outputted from the LCD/touch panel controller 44.

(ii) ON Operation of the Liquid Crystal Display (LCD) 13 Due to the Operation of the Power Key 25

The OFF state of the display of the liquid crystal display (LCD) 13 having such a structure, that is, from the stand-by mode of the liquid crystal display (LCD) 13, when the aforementioned power switch 25 is press-touched, an ON signal from the power switch 25 is fed to the system controller 31, whereby the engine controller 32, the fax controller 33, and the like are caused to return from the stand-by mode by the system controller 31.

Together with the return from the stand-by mode, the system controller 31 controls the operation of the CPU 40 to thereby apply the power source voltage VCC (+5V) of the power source unit 28 to the LCD/touch panel controller 44 in order to initiate the operation of returning the LCD/touch panel controller 44 from the stand-by mode.

At this point, the power source voltage VCC applied to the LCD/touch panel controller 44 gradually rises (increase voltage) from the time t1 and becomes a maximum voltage at the time t2 as shown in FIG. 10.

The logic voltage detecting circuit 47 detects the voltage VTH as a reference voltage (logic circuit voltage, threshold voltage, namely, setting voltage) at the time t2' which is the time immediately before the time t2 at which the voltage VCC applied to the circuit of the LCD/touch panel controller 44 becomes a maximum voltage. The reference voltage is, for example, set to about 80% of the maximum of the power source voltage VCC in the present embodiment. It is to be noted that the reset signal outputted from the logic voltage detecting circuit 47 is set to "L" until the voltage VCC applied to the LCD/touch panel controller 44 becomes a maximum voltage at the time t2 and is stable as well. That is to say, the reset signal is set to "L" from the time the logic voltage detecting circuit 47 detects the reference voltage VTH at the time t2' until only a fixed period (time) T elapses.

Next, the logic voltage detecting circuit 47 switches the reset signal from "L" to "H" at the time t3 when only the fixed period (time) T has elapsed since the detection of the reference voltage VTH at the time t2' (t3>t2>t2'), and outputs the switched reset signal "H" as a logic circuit voltage detecting signal. The reset signal "H" is then fed to the LCD/touch panel controller 44. Upon input of the reset signal "H", the LCD/touch panel controller 44 outputs a timing signal to the liquid crystal display (LCD) 13. Thus, until the point at which the logic circuit voltage VCC becomes completely stable, the logic voltage detecting circuit 47 switches the reset signal from "L" to "H" with a delay of a time T and outputs the reset signal.

In the meantime, the voltage of the reset signal "H" is simultaneously applied to the transistor Q1 of the LCD drive power source supply/interruption circuit 50 via the resistor R1 and the transistor Q3 of the LCD electric charge compulsory discharge circuit 52 via the resistor R4 at the time t3.

The transistor Q1 is rendered ON when the reset signal from the logic voltage detecting circuit 47 turns to "H" at the time t3. Accordingly, a current caused by the power source voltage +24V of the power source unit 28 flows to earth via the resistors R3, R2 and the transistor Q1, the voltage applied to the gate of the FET Q2 becomes a voltage from the +24V partially pressurized at the resistor R3 (having a value sufficiently lower than that of +24V), and the source and drain of the FET Q2 are in a conductive state, whereby the FET Q2 is turned ON. Due to the FET Q2 being turned ON, the power source voltage +24V of the power source unit 28 is outputted as the drive voltage VEE from the drain of the FET Q2. The drive voltage VEE is applied to the drive circuit (not shown) of the liquid crystal display (LCD) 13.

Further, the transistor Q3 of the LCD electric charge compulsory discharge circuit 52 is rendered OFF when the reset signal from the logic voltage detecting circuit 47 turns to "H" at the time t3 and the power source voltage VCC that was applied to the base of the transistor Q4 is interrupted, whereby the transistor Q4 is turned OFF. Accordingly, the drive voltage VEE, which will be outputted from the FET Q2, can be normally applied to the drive circuit (not shown) of the liquid crystal display (LCD) 13. The drive voltage VEE starts rising (increase voltage) from the time t3 and becomes a maximum +24V at the time t4.

Accordingly, the liquid crystal display (LCD) 13, having its operation controlled by the timing signal of a frame signal or the like from the LCD/touch panel controller 44, displays the present setting conditions and the controlled state of the respective portions of the image forming apparatus 10. The drive voltage VEE is thus applied to the drive circuit (not shown) of the liquid crystal display (LCD) 13 from the time t3, which is later than the time t2 where the circuit voltage (voltage for the logic circuit) VCC reaches maximum (stable). Therefore, a current from the drive circuit of the liquid crystal display (LCD) 13 is prevented from flowing back to the logic circuits of the operation portion controller 30 including the LCD/touch panel controller 44, whereby deterioration caused by starting the operation of the liquid crystal display (LCD) 13 is prevented at the time of starting the operation of the liquid crystal display (LCD) 13.

(iii) OFF Operation of the Liquid Crystal Display (LCD) 13 Due to the Operation of the Power Key 25

In addition, when the power key 25 is operated ON at a time t5 under the state in which the liquid crystal display (LCD) 13 is ON and displaying the present setting conditions and the controlled state of the respective portions of the image forming apparatus 10, the ON operation of the power key 25 is inputted to the system controller 31.

Upon input of an ON signal from the power key 25 at the time t5, controllers such as the engine controller 32 and the fax controller 33 are switched to the stand-by mode by the system controller 31.

In the meantime, upon input of the ON signal from the power key 26 at the time t5, the system controller 31 turns OFF the voltage VCC that is applied to the LCD/touch panel controller 44. Application of the drive power source +24V to the liquid crystal display (LCD) 13 is thus turned OFF at a time t6. At this time, the voltage VCC of the LCD/touch panel controller 44 starts to drop from the time t5 towards a time t9 (decrease voltage). In addition, the voltage of the power source +24V starts to drop from the time t6 towards a time t10.

Next, the logic voltage detecting circuit 47, upon detecting the reference voltage VTH at a time t7, immediately outputs the reset signal "L" at the time t7 as the logic voltage detecting signal and inputs the reset signal "L" to the LCD/touch panel controller 44.

Upon input of the reset signal "L", the LCD/touch panel controller 44 stops the output of the timing signal, thereby suspending the display control of the liquid crystal display (LCD) 13.

In the meantime, the voltage of the reset signal "L" is applied to the base of the transistor Q1 of the LCD drive power source supply/interruption circuit 50 via the resistor R1 as well as to the base of the transistor Q3 of the LCD electric charge compulsory discharge circuit 52 via the resistor R4 at the time t7.

The transistor Q1 of the LCD drive power source supply/interruption circuit 50 is rendered OFF when the reset signal from the logic voltage detecting circuit 47 turns to "L" at the time t7. Accordingly, the power source voltage +24V of the power source unit 28 is applied to the gate of the FET Q2 via the resistor R3 and the conductivity between the source and drain of the FET Q2 is interrupted, whereby the FET Q2 is turned OFF. Consequently, the FET Q2 stops the output of the drive voltage VEE (+24V) from the drain thereof, thereby interrupting the drive voltage VEE (+24V), which is applied to the drive circuit (not shown) of the liquid crystal display (LCD) 13 as the drive voltage VEE.

Simultaneously, the transistor Q3 of the LCD electric charge compulsory discharge circuit 52 is rendered ON when the reset signal from the logic voltage detecting circuit 47 turns to "L" at the time t7 to thereby apply the power source voltage VCC to the base of the transistor Q4 via the transistor Q3 and the resistor R6. Accordingly, the transistor Q4 is turned ON, whereby the drain of the FET Q2 is in conductivity to the earth via the discharge electric current restriction resistor RL. Accordingly, the residual charge brought about by the drive voltage VEE, that is, the residual charge of the drive circuit (not shown) of the liquid crystal display (LCD) 13 is forcibly discharged to the earth by the discharge electric current restriction resistor RL, which is the discharge electric current restriction circuit), via the transistor Q4. At this point, since the residual charges brought about by the drive voltage VEE are caused to flow to the earth by the maximum current value restricted at the discharge electric current restriction resistor RL, the drive voltage VEE drops precipitately and reaches 0V at a time t8.

Thus forced discharge is precipitately performed so that the residual charge of the drive voltage VEE becomes 0V at the time t5 long before the voltage VCC of the LCD/touch panel controller 44 becomes 0V at the time t9.

Incidentally, when there is not provision of a compulsory discharge circuit such as the LCD electric charge compulsory discharge circuit 52, then the residual charge brought about by the drive voltage VEE, that is, the residual charge of the unillustrated drive circuit of the liquid crystal display (LCD) 13 will slowly drop between the time t6 and t10, and hence a voltage due to the residual charge of the unillustrated drive circuit of the liquid crystal display (LCD) 13 will not become 0V even if the voltage VCC of the LCD/touch panel controller 44 becomes 0V at the time t9. However, according to the present invention, the residual charge of the drive voltage VEE is precipitately discharged between the time t7 and t8 and becomes 0V at the time t8 long before the voltage VCC of the LCD/touch panel controller 44 becomes 0V at the time t9.

According to this result, for example, even if a relatively large number of capacitors are provided in the unillustrated drive circuit of the liquid crystal display (LCD) 13 for the purpose of enhancing the display quality thereof, there will be no delay in the discharge of the residual charge inside the liquid crystal display (LCD) 13 when power source interruption occurs due to the FET Q2 being turned OFF. Therefore, the driving power source of the liquid crystal display (LCD) 13, that is, the fall of the residual charge due to the drive voltage VEE will not be incidentally delayed.

Further, when performing forced discharge, the discharge electric current restriction resistor RL, which is the discharge electric current restriction circuit, restricts the discharge electric current so that it becomes lower than the electric current value permissible to the transistor Q4 of the LCD electric charge compulsory discharge circuit 52. Even when the FET Q2 of the LCD drive power source supply/interruption circuit 50 and the transistor Q4 of the LCD electric charge compulsory discharge circuit 52 are simultaneously rendered ON at a timing when the reset signal is switched from "H" to "L", the discharge electric current restriction resistor RL restricts the penetrating current of the FET Q2 and the transistor Q4 so that it becomes lower than the electric current value permissible to the FET Q2 and the transistor Q4, whereby both the FET Q2 and the transistor Q4 will not be destroyed.

Taking the capacitance (residual charge) inside the liquid crystal display (LCD) 13 to be used into consideration, it should be noted that a resistance value capable of discharging VEE before VCC drops completely is selected for the electric current restriction resistor RL, which is provided in series with the transistor Q4. In addition, since the electric current restriction resistor RL also has a role to protect a transistor when a penetrating current is generated due to the operating timing of the transistor Q2 and the transistor Q4, it is necessary to provide the electric current restriction resistor RL in series with the transistor Q4.

Thus, discharge electric current restriction means is the discharge electric current restriction resistor RL that has a resistance value which restricts the discharge current flowing in the transistor Q4 to a level that will not destroy the transistor Q4 when the transistor Q4, which is the switching element, is in operation. Moreover, the discharge electric current restriction resistor RL has a resistance value set therein to restrict the discharge electric current so that the discharge of the residual charge of the liquid crystal display (LCD) 13 ends before the circuit drive voltage of the logic circuit becomes 0V.

According to this structure, the residual charge of the drive voltage VEE is precipitately discharged between the time t7 and t8 and becomes 0V at the time t8 long before the voltage VCC of the LCD/touch panel controller 44 becomes 0V at the time t9 as mentioned above. Moreover, in addition to the transistor Q4 serving as the switching element, the discharge electric current restriction resistor RL is provided, and therefore a maximum discharge current value to be flowed to the transistor Q4, which is a transistor for discharging, can be set in accordance with the residual charge amount of the liquid crystal display (LCD) 13 to be used. Protecting the transistor Q4 for performing discharge can thus be achieved. In other words, when the residual charge of the liquid crystal display (LCD) 13 is discharged via the transistor Q4, the current flowing to the transistor Q4 is restricted by the discharge electric current restriction resistor RL so that it will not destroy the transistor Q4. Therefore, destruction of the transistor Q4 due to the forced discharge of the residual charge can be prevented beforehand with a simple structure.

Embodiment 2

Figure 11:
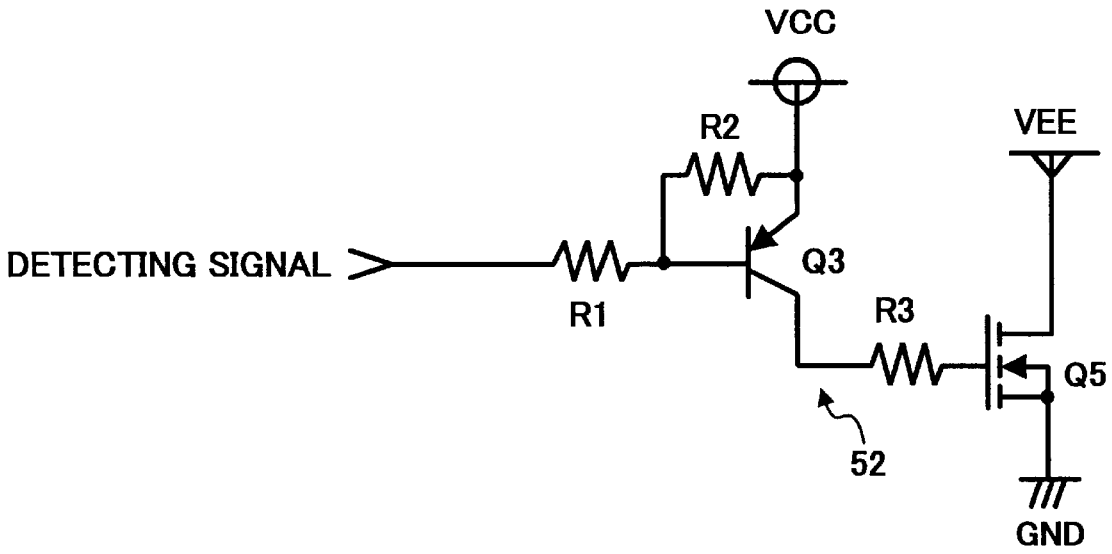
FIG. 11 is a partial control circuit diagram showing another example of the LCD drive voltage compulsory discharge means shown in FIG. 9.

FIG. 11 is a drawing showing a second embodiment of the present invention. In this method, a FET Q5 (switching element, transistor) substituting the transistor Q4 of FIG. 9 is employed as the LCD electric charge compulsory discharge means (LCD residual charge compulsory discharge means), and the electric current restriction resistor RL is removed. Even though a drain/source of the FET Q5 is in a conductive state, when the FET Q5 is ON, an inherent conductive resistor (discharge electric current restriction resistor as discharge electric current restriction means) of the FET Q5 exists between the drain/source thereof as an internal resistance. Thus, the inherent conductive resistor of the FET Q5 can restrict the drain current.

Accordingly, by selecting a FET Q5 that has a suitable resistance value of the conductive resistor, the electric current restriction resistor (RL) can be removed. It should be noted that the operation of this structure except that of the FET Q5 is the same as the embodiment of FIG. 9, and therefore the description thereof is omitted.

The conductive resistor in this case may be set with a resistance value so as not to exceed an allowable total loss to the FET Q5, and furthermore, it is necessary not to exceed a maximum drain current value of the FET Q5 at this point. As an example, when the VEE is +24V and the total loss is 2W, the discharge electric current restriction resistor to be used becomes 242/2=288Ω. Therefore, a FET Q5 having a resistance value of a conductive resistor greater than 288Ω may be selected.

Figure 12:
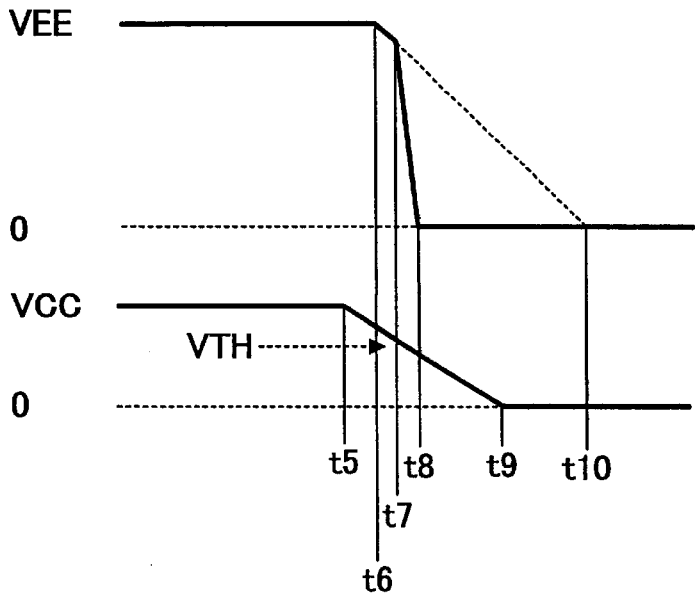
FIG. 12 is a time chart for explaining an operation of the control circuit diagram shown in FIG. 11.
Figure 13:
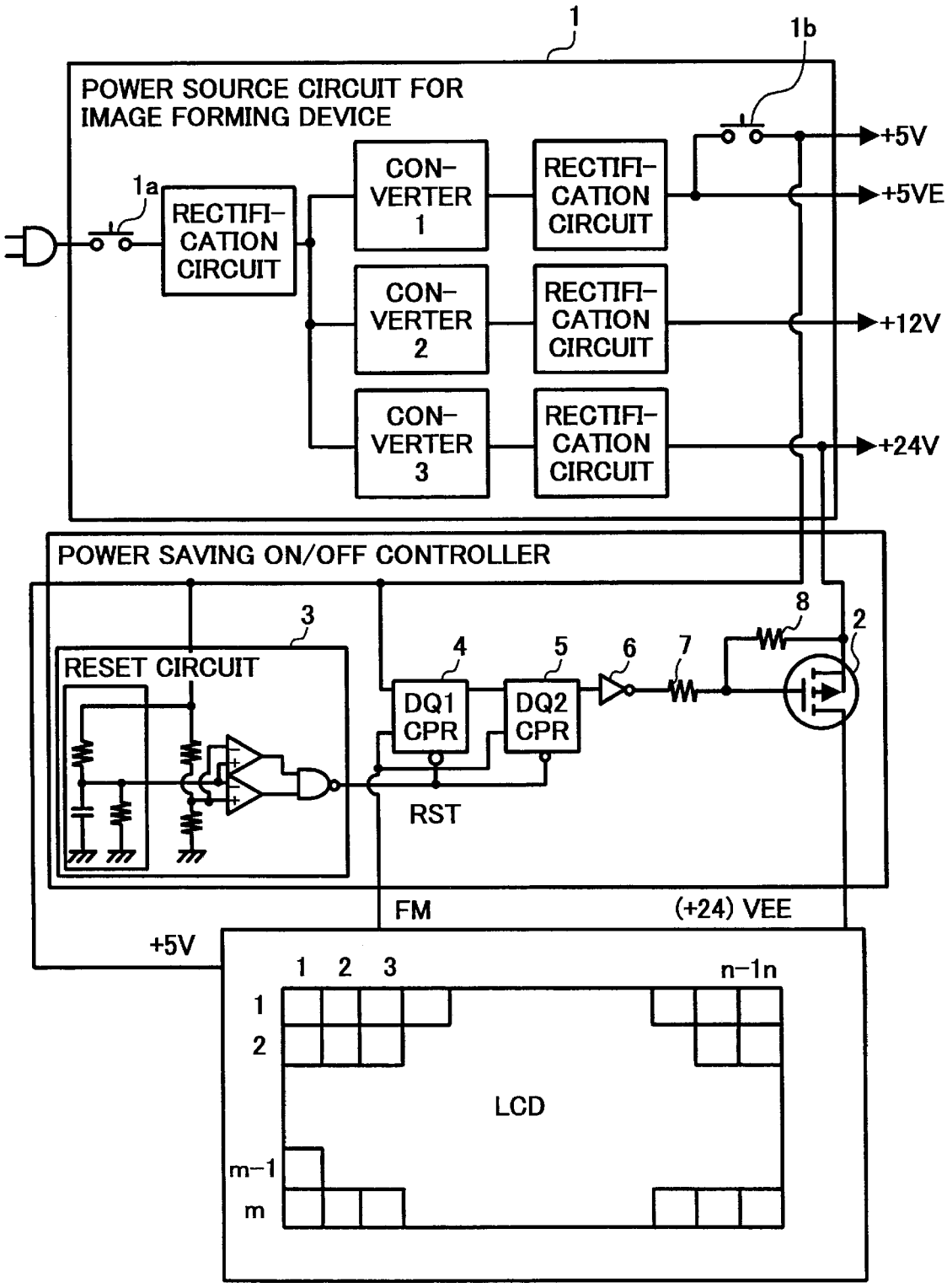
FIG. 13 is a circuit diagram of an operation panel control circuit of a conventional image forming apparatus.

According to such a structure, when controllers such as the engine controller 32 and the fax controller 33 are switched to the stand-by mode by the system controller 31 due to the operation of the power switch 25, the voltage VCC applied to the LCD/touch panel controller 44, which is a part of the logic circuit, is turned OFF at the time t5 as shown in FIG. 12. The voltage VCC starts to drop and the power source +24V of the liquid crystal display (LCD) 13 is turned OFF at the time t6. Therefore, the voltage VCC starts to drop from the time t5 towards the time t9, and together therewith, the voltage of the power source +24V starts to drop from the time t6 towards the time t10.

Together with the above voltage drop, the above-mentioned FET Q2 is turned OFF at the time t7, whereby the power voltage +24V applied from the power source of the power source unit 28 to the liquid crystal display (LCD) 13 is interrupted by the above-mentioned FET Q2. Next, when the decreasing voltage of the voltage VCC reaches a predetermined value at the time t7, the voltage thereof is detected by the logic circuit voltage detecting circuit 47.

Upon detecting the voltage decreasing to the predetermined value at the time t7, the logic circuit voltage detecting circuit 47 outputs the reset signal "L". The reset signal "L" is then fed to the base of the transistor Q3 to thereby turn the transistor Q3 ON. When the transistor Q3 is ON, the power source voltage VCC of the power source unit 28 is applied to a gate of the FET Q5 via the transistor Q3, whereby the FET Q5 is ON at the time t7. As a result of turning ON the FET Q5, the residual charge of the liquid crystal display (LCD) 13 caused by the voltage VEE is swiftly discharged to the earth via the FET Q5. The discharge of the residual charge is conducted rapidly between the time t7 and t8 and the residual charge of the liquid crystal display (LCD) 13 becomes 0V at the time t7.

Thereafter, the voltage VCC applied to the LCD/touch panel controller 44 becomes 0V at the time t7.

It should be noted that when the FET Q5 is not provided, the voltage VEE slowly drops (decrease voltage) between the time t6 and the time t10 and reaches 0V at the time t10 (t10>t9>t8) as shown by the dotted line in FIG. 12 when the power voltage +24V applied from the power source of the power source unit 28 to the liquid crystal display (LCD) 13 is interrupted at the time t7 by the above-mentioned FET Q2. Hence, when the FET Q5 is not provided, the voltage VCC of the LCD/touch panel controller 44 constituting a portion of the logic circuit becomes 0V at the time t8 before the voltage VEE becomes 0V, thus causing damage to the liquid crystal display (LCD) 13 and flickering of the display thereof.

However, by rapidly discharging the residual charge of the liquid crystal display (LCD) 13 between the time t7 and the time t8, in other words, by causing the voltage VEE to become 0V at the time t7 far before the voltage VCC of the LCD/touch panel controller 44 constituting a portion of the logic circuit becomes 0V at the time t9 as in the present embodiment, damage to the liquid crystal display (LCD) 13 and flickering of the display thereof are prevented beforehand.

Note that the reset IC was used in place of the generation of the voltage-lowering signal in the present invention. However, a comparator or the like may be used to set a different voltage. Further, when the logic power source of the liquid crystal display (LCD) 13 is generated by a series regulator or the like from the drive voltage, the input voltage of the series regulator is monitored so that the voltage thereof may be set to a level higher than the logic voltage when it starts to fall.

It should be noted that though an example of using the FET Q5 as the discharge switching element was shown herein, a MOS FET can be used for the discharge switching element.

(Supplementary Explanation)

In the LCD power source control method of the present invention, the voltage detecting means (logic voltage detecting circuit 47) detects the voltage VCC of the +5V logic circuit power source of the power source unit 28 in the module, the supply/interruption of the voltage VEE of the +24V power source thereof from the LCD drive power source to the LCD control circuit (drive circuit of the liquid crystal display not shown in the drawing) is performed by the LCD power source supply/interruption means (LCD drive power source supply/interruption means 50). Meanwhile, the residual charge of the LCD drive circuit is forcibly discharged by means of the compulsory discharge means (LCD charge compulsory discharge circuit 52) as well when the aforementioned LCD power source supply/interruption means (LCD drive power source supply/interruption means 50) is performing interruption. Moreover, in the LCD power source control method, upon detecting a voltage drop of the logic circuit power source, the aforementioned voltage detecting means (logic voltage detecting circuit 47) immediately outputs a signal indicating the voltage drop (reset signal "L"), whereby together with causing the LCD power source supply/interruption means (LCD drive power source supply/interruption means 50) to be in the interruption state, the compulsory discharge means (LCD electric charge compulsory discharge circuit 52) is caused to be in the operation state to thereby control discharge so that the residual charge of the LCD drive circuit is forcibly discharged by means of the compulsory discharge means (LCD electric charge compulsory discharge circuit 52) before the voltage of the logic circuit power source becomes 0V.

Herein, for example, the liquid crystal display module is formed of a glass substrate provided with a pair of electrode plates having a transparent conductive film disposed thereon as a plurality of electrodes and a liquid crystal layer, a polarizing plate, and the like arranged between the electrode plates. Such a liquid crystal display has a capacitance of a high resistance. A structure of an equivalent circuit composed of the electrode plate and the liquid crystal layer of the liquid crystal display can be shown as a parallel circuit of a resistor and a capacitor. The structure of the LCD control circuit (LCD drive circuit) for controlling and driving the liquid crystal itself in such manner becomes a structure including a pair of electrode plates and the liquid crystal layer.

Therefore, according to the LCD power source control method, the compulsory discharge of the residual charge of the liquid crystal display (LCD) 13 can be instantly terminated during the times between when the voltage detecting means (logic voltage detecting circuit 47) detects the voltage drop of the voltage VCC (circuit drive voltage) from the +5V power source of the logic circuit (operation portion controller 30) and when the circuit drive voltage becomes 0V.

According to this result, for example, even if a relatively large number of capacitors are provided inside the LCD (liquid crystal display (LCD) 13) for the purpose of enhancing the display quality thereof, the discharge of the residual charge inside the LCD is performed instantaneously and forcibly when the supply of electricity to the LCD is interrupted at the time of power interruption. As a result, the fall of the LCD drive voltage (liquid crystal display drive voltage) is instantaneously performed so that the LCD drive voltage can become 0V before the logic circuit voltage becomes 0V. Therefore, the reverse flow of a current from the drive circuit of the liquid crystal display (LCD) 13 to the logic circuit (operation portion controller 30) when the operation of the liquid crystal display (LCD) 13 is OFF, that is, when the LCD power source supply/interruption means is performing interruption is prevented. Damage to the logic circuit and the liquid crystal display (LCD) 13 when the operation of the liquid crystal display (LCD) 13 is OFF is thus prevented.

Further, in the LCD power source control method, upon detecting a rise in the voltage VCC of the +5V power source of the logic circuit, the voltage detecting means (logic voltage detecting circuit 47) can be rendered to delay the output of the signal indicating the voltage rise (reset signal "H") for a fired time (period T) until the voltage VCC of the logic circuit power source becomes stable at a predetermined voltage, whereby together with causing the LCD power source supply/interruption means (LCD drive power source supply/interruption circuit 50) to a power supplying state, the compulsory discharge means (LCD charge compulsory discharge circuit 52) is controlled to be in the open state.

According to the LCD power source control method, deterioration of the logic circuit (operation portion controller 30) and the liquid crystal display (LCD) 13 is prevented when the LCD power source supply/interruption means (LCD drive power source supply/interruption circuit 50) is rendered to the power supply state.

Still further, the LCD power source control circuit 49 employed in such a control method can include: a plurality of power sources (power source unit 28) structured so that at least 2 power sources or more are supplied, having the logic circuit power source (power source of +5V of the power source unit 28) in the module and the LCD drive power source (power source of +24V of the power source unit 28); the voltage detecting means (logic voltage detecting circuit 47) for detecting the voltage VCC of the logic circuit power source (power source of +5V); the LCD power source supply/interruption means (LCD drive power source supply/interruption circuit 50) for performing supply/interruption of a voltage from the LCD drive power source (power source of +5V) to the LCD control circuit (LCD drive circuit); and the compulsory discharge means (LCD charge compulsory discharge circuit 52) for forcibly discharging the residual charge of the LCD drive circuit when the LCD power source supply/interruption means (LCD drive power source supply/interruption circuit 50) is in interruption. In addition, the voltage detecting means (logic voltage detecting circuit 47) immediately outputs the signal indicating the voltage drop (reset signal "L") upon detecting a drop in the voltage VCC of the logic circuit power source (power source of +5V), whereby together with causing the LCD power source supply/interruption means (LCD drive power source supply/interruption means 50) to be in the interruption state, the compulsory discharge means (LCD charge compulsory discharge circuit 52) is caused to be in the operation state to thereby forcibly discharge the residual charge of the LCD drive circuit by means of the compulsory discharge means (LCD charge compulsory discharge circuit 52) before the voltage VCC of the logic circuit power source (power source of +5V) becomes 0V.

Therefore, according to the LCD power source control method, the compulsory discharge of the residual charge of the liquid crystal display (LCD) 13 can be instantly terminated during times between when the voltage detecting means (logic voltage detecting circuit 47) detects the voltage drop of the voltage (circuit drive voltage) VCC from the power source of +5V of the logic circuit (operation portion controller 30) and when the circuit drive voltage becomes 0V.

According to this result, for example, even if a relatively large number of capacitors are provided inside the LCD (liquid crystal display (LCD) 13) for the purpose of enhancing the display quality thereof, the discharge of the residual charge inside the LCD is performed instantaneously and forcibly when the supply of power to the LCD is interrupted at the time of power interruption. As a result, the fall of the LCD drive voltage (liquid crystal display drive voltage) is instantaneously performed so that the LCD drive voltage can become 0V before the logic circuit voltage becomes 0V. Therefore, the reverse flow of a current from the drive circuit of the liquid crystal display (LCD) 13 to the logic circuit (operation portion controller 30) when the operation of the liquid crystal display (LCD) 13 is OFF, that is, when the LCD power source supply/interruption means is performing interruption, is prevented. Damage to the logic circuit and the liquid crystal display (LCD) 13 when the operation of the liquid crystal display (LCD) 13 is OFF is thus prevented.

Further, upon detecting a rise in the voltage VCC of the logic circuit power source (power source of +5V), the voltage detecting means (logic voltage detecting circuit 47) of the LCD power source control method can be rendered to delay the output of the signal indicating the voltage rise (reset signal "H") for a fixed time (period T) until the voltage VCC of the logic circuit power source becomes stable at a predetermined voltage, whereby together with causing the LCD power source supply/interruption means (LCD drive power source supply/interruption circuit 50) to a power supplying state, the compulsory discharge means (LCD charge compulsory discharge circuit 52) is caused to be in the open state.

According to the LCD power source control circuit including such voltage detecting means (logic voltage detecting circuit 47), deterioration of the logic circuit (operation portion controller 30) and the liquid crystal display (LCD) 13 is prevented when the LCD power source supply/interruption means (LCD drive power source supply/interruption means 50) is rendered to the power supply state.

Further, the LCD power source control circuit can be provided with the discharge electric current restriction means (discharge electric current restriction circuit 51) therein to prevent a large current from flowing between the LCD power source supply/interruption means (LCD drive power source supply/interruption circuit 50) and the compulsory discharge means (LCD charge compulsory discharge circuit 52) when both means are in operation at the same time.

According to this structure, a maximum discharge electric current value flowing in the compulsory discharge means (LCD charge compulsory discharge circuit 52) can be set to match the amount of the residual charge of the liquid crystal display (LCD) 13 to be used because the discharge electric current restriction means (discharge electric current restriction circuit 51) is provided therein. In addition, protection of the compulsory discharge means (LCD charge compulsory discharge circuit 52) can be performed. In other words, when the residual charge of the liquid crystal display (LCD) 13 is discharged by means of the compulsory discharge means (LCD charge compulsory discharge circuit 52), the discharge electric current restriction means (discharge electric current restriction circuit 51) restricts the current flowing in the compulsory discharge means (LCD charge compulsory discharge circuit 52) so that the compulsory discharge means (LCD charge compulsory discharge circuit 52) is not destroyed, whereby damage to the compulsory discharge means (LCD charge compulsory discharge circuit 52) due to the forced discharge of the residual charge can be prevented beforehand.

Still further, the LCD power source supply/interruption means (LCD drive power source supply/interruption circuit 50) is switched to the interruption state due to the signal (reset signal "L") indicating that the voltage detecting means (logic voltage detecting circuit 47) detects a voltage drop of the voltage VCC. Further, the LCD power source supply/interruption means (LCD drive power source supply/interruption circuit 50) can include a drive switching element (FET Q2) connected to the LCD power source (power source of the voltage VEE) which is switched to a discharge state due to the signal indicating that a voltage rise of the voltage VCC (reset signal "H"). In addition, the compulsory discharge means (LCD charge compulsory discharge circuit 52) can include a discharge switching element (transistor Q4 or FET Q5) connected to earth. The discharge switching element (transistor Q4 or FET Q5) can be set so that it is rendered to the operating state due to the signal (reset signal "L") indicating that the voltage detecting means (logic voltage detecting circuit 47) detects a voltage drop of the voltage VCC and rendered to the open state due to the signal (reset signal "H") indicating that a voltage rise of the voltage VCC is detected.

According to this structure, the LCD power source of the +24V of the power source unit 28 can be interrupted or supplied to the LCD drive circuit (not shown) of the liquid crystal display (LCD) 13 with a simple structure. The discharge of the residual charge of the LCD drive circuit can also be performed with a simple structure.

Further, the discharge electric current restriction means (discharge electric current restriction circuit 51) can be a resistor (discharge electric current restriction resistor RL) connected in series between the LCD power source supply/interruption means (LCD drive power source supply/interruption circuit 50) and the compulsory discharge means (LCD charge compulsory discharge circuit 52).

According to this structure, the resistor RL for restricting discharge electric current is provided therein. Therefore, a resistance value of the resistor RL is set to match the amount of the residual charge of the liquid crystal display (LCD) 13 to be used, whereby a maximum discharge electric current value flowing in the compulsory discharge means (LCD charge compulsory discharge circuit 52) can be simply and easily set. In addition, protection of the compulsory discharge means (LCD charge compulsory discharge circuit 52) can be performed. In other words, when the residual charge of the liquid crystal display (LCD) 13 is discharged by means of the compulsory discharge means (LCD charge compulsory discharge circuit 52), the discharge electric current restriction resistor RL restricts the current flowing in the compulsory discharge means (LCD charge compulsory discharge circuit 52) so that the compulsory discharge means (LCD charge compulsory discharge circuit 52) is not destroyed, whereby damage to the compulsory discharge means (LCD charge compulsory discharge circuit 52) owing to forced discharge of the residual charge can be prevented beforehand.

Still further, the LCD power source supply/interruption means (LCD drive power source supply/interruption means 50) can be provided with, in addition to the drive switching element (FET Q2), a first control switching element (transistor Q1), which is connected to earth, and a plurality of resistors (R1 to R3).

According to this structure, the ON/OFF control of the drive switching element (FET Q2) can be easily performed by the first control switching element (transistor Q1) and the plurality of resistors (R1 to R3).

Further, the compulsory discharge means (LCD charge compulsory discharge circuit 52) can be provided with a second control switching element (transistor Q3), which is connected to the control logic circuit power source, and a plurality of resistors (R4 to R6) in addition to the discharge switching element (transistor Q4 or FET Q5).

According to this structure, the ON/OFF control of the discharge switching element (transistor Q4 or FET Q5) can be easily performed by the second control switching element (transistor Q3), which is connected to the control logic circuit power source, and the plurality of resistors (R4 to R6).

Still further, the drive switching element (FET Q2), the discharge switching element (transistor Q4 or FET Q5), and the first and second switching elements (transistors Q1 and Q3) can be formed of transistors Q1 to Q5 having the above-mentioned respective characteristics.

Further, the discharge switching element (FET Q5) can be a MOS FET also serving as the discharge electric current control resistor due to an internal resistor.

According to this structure, when performing forced discharge of the residual charge of the liquid crystal display (LCD) 13 to be used, the maximum discharge electric current value flowing in the discharge MOS FET can be set according to the amount of the residual charge of the liquid crystal display (LCD) 13 to be used by selecting the MOS FET which has an internal resistor that will not be destroyed by the current flowing therein. In addition, protection of the discharge MOS FET can be conducted. Furthermore, the means to forcibly discharge the residual charge of the liquid crystal display (LCD) 13 can be structured at a low cost. The structure of the compulsory discharge means C can be simplified by reducing one of the components compared with the one formed of the discharge switching element (transistor Q4) and the discharge electric current restriction means (discharge electric current restriction resistor RL).

Further, the voltage detecting means (logic voltage detecting circuit 47) can be set so that it judges that a voltage drop has been detected when the voltage VCC of the logic circuit power source becomes lower than a predetermined threshold value and judges that a voltage rise has been detected when the voltage VCC of the logic circuit power source becomes higher than the predetermined threshold value. In practice, the voltage detecting means outputs the reset signal "L" or "H" in response to the above judgment.

Further, the voltage detecting means (logic voltage detecting circuit 47) can be set so that the signal indicating a voltage rise is not immediately outputted but delayed for a fixed time, whereby the signal is outputted after the voltage of the logic circuit power source becomes stable at a voltage of operation.

Therefore, the reverse flow of a current from the drive circuit of the liquid crystal display (LCD) 13 to the logic circuit (operation portion controller 30) at the operation start time of the liquid crystal display (LCD) 13 is prevented. Damage to the logic circuit (operation portion controller 30) and the liquid crystal display (LCD) 13 at the operation start time of the liquid crystal display (LCD) 13 is thus prevented.

Further, the voltage detecting means (logic voltage detecting circuit 47) can be structured to share a reset circuit for resetting the logic circuit (LCD/touch panel controller 44 of the operation portion controller 30) and the control means (CPU 40) thereof when the voltage detecting means (logic voltage detecting circuit 47) has detected a voltage drop of the logic circuit power source and releasing the reset when a voltage rise has been detected so that the control means (CPU 40) of the logic circuit (LCD/touch panel controller 44 of the operation portion controller 30) does not go out of control.

What is claimed is:

1. An LCD power source control method comprising steps of:

detecting a voltage of a logic circuit power source in a module by means of voltage detecting means;

performing supply/interruption of a voltage from an LCD drive power source to an LCD control circuit by means of LCD power source supply/interruption means;

outputting immediately a signal indicating a voltage drop of said logic circuit power source by said voltage detecting means upon detection of the voltage drop;

causing said LCD power source supply/interruption means to be in an interruption state, and causing compulsory discharge means to be in an operation state to thereby control discharge so that a residual charge of an LCD drive circuit is forcibly discharged by means of said compulsory discharge means before the voltage of said logic circuit power source becomes 0V.

2. An LCD power source control method comprising steps of:

detecting a voltage of a logic circuit power source in a module by means of voltage detecting means;

performing supply/interruption of a voltage from an LCD drive power source to an LCD control circuit by means of LCD power source supply/interruption means;

causing a residual charge of an LCD drive circuit to forcibly discharge by compulsory discharge means when said LCD power source supply/interruption means is performing interruption; and upon detection of a voltage rise of said logic circuit power source, said voltage detecting means delaying the output of a signal indicating the voltage rise for a fixed time until the voltage of said logic circuit power source becomes stable at a predetermined voltage, whereby together with causing said LCD power source supply/interruption means to a power supply state, said compulsory discharge means is controlled to be in an open state.

3. An LCD power source control circuit comprising:

a plurality of power sources structured so that at least 2 power sources or more are supplied, having said logic circuit power source in a module and other of an LCD drive power source, voltage detecting means for detecting a voltage of said logic circuit power source, and LCD power source supply/interruption means for performing supply/interruption of a voltage from said LCD drive power source to an LCD control circuit, wherein:

compulsory discharge means is provided for forcibly discharging a residual charge of an LCD drive circuit when said LCD power source supply/interruption means is performing interruption, and upon detecting a voltage drop of said logic circuit power source, said voltage detecting means immediately outputs a signal indicating the voltage drop, whereby together with causing said LCD power source supply/interruption means to be in an interruption state, said compulsory discharge means is caused to be in an operation state to thereby forcibly discharge the residual charge of said LCD drive circuit by means of said compulsory discharge means before the voltage of said logic circuit power source becomes 0V.

4. An LCD power source control circuit comprising:

a plurality of power sources structured so that at least 2 power sources or more are supplied, having said logic circuit power source in a module and an LCD drive power source, voltage detecting means for detecting a voltage of said logic circuit power source, and LCD power source supply/interruption means for performing supply/interruption of a voltage from said LCD drive power source to an LCD control circuit, wherein:

compulsory discharge means is provided for forcibly discharging a residual charge of an LCD drive circuit when said LCD power source supply/interruption means is performing interruption, and upon detection of a voltage rise of said logic circuit power source, said voltage detecting means delays the output of a signal indicating the voltage rise for a fixed time until the voltage of said logic circuit power source becomes stable at a predetermined voltage, whereby together with causing said LCD power source supply/interruption means to a power supply state, said compulsory discharge means is caused to be in an open state.

5. The LCD power source control circuit according to claim 3, wherein discharge electric current restriction means is provided to prevent a large current from flowing between said LCD power source supply/interruption means and said compulsory discharge means when both means are in operation at the same time.

6. The LCD power source control circuit according to claim 4, wherein discharge electric current restriction means is provided to prevent a large current from flowing between said LCD power source supply/interruption means and said compulsory discharge means when both means are in operation at the same time.

7. The LCD power source control circuit according to claim 3, wherein said LCD power source supply/interruption means includes a drive switching element connected to the LCD power source, which is switched to the interruption state due to a signal indicating that said voltage detecting means detects a voltage drop and which is switched to a discharge state due to a signal indicating that said voltage detecting means detects a voltage rise, and wherein said compulsory discharge means includes a discharge switching element connected to earth, which is switched to an operating state due to a signal indicating that said voltage detecting means detects a voltage drop and which is switched to an open state due to a signal indicating that said voltage detecting means detects a voltage rise.

8. The LCD power source control circuit according to claim 4, wherein said LCD power source supply/interruption means includes a drive switching element connected to the LCD power source, which is switched to an interruption state due to a signal indicating that said voltage detecting means detects a voltage drop and which is switched to a discharge state due to a signal indicating that said voltage detecting means detects a voltage rise, and wherein said compulsory discharge means includes a discharge switching element connected to earth, which is switched to an operating state due to a signal indicating that said voltage detecting means detects a voltage drop and which is switched to the open state due to a signal indicating that said voltage detecting means detects a voltage rise.

9. The LCD power source control circuit according to claim 5, wherein said LCD power source supply/interruption means includes a drive switching element connected to the LCD power source, which is switched to the interruption state due to a signal indicating that said voltage detecting means detects a voltage drop and which is switched to a discharge state due to a signal indicating that said voltage detecting means detects a voltage rise, and wherein said compulsory discharge means includes a discharge switching element connected to earth, which is switched to an operating state due to a signal indicating that said voltage detecting means detects a voltage drop and which is switched to an open state due to a signal indicating that said voltage detecting means detects a voltage rise.

10. The LCD power source control circuit according to claim 6, wherein said LCD power source supply/interruption means includes a drive switching element connected to the LCD power source, which is switched to an interruption state due to a signal indicating that said voltage detecting means detects a voltage drop and which is switched to a discharge state due to a signal indicating that said voltage detecting means detects a voltage rise, and wherein said compulsory discharge means includes a discharge switching element connected to earth, which is switched to an operating state due to a signal indicating that said voltage detecting means detects a voltage drop and which is switched to the open state due to a signal indicating that said voltage detecting means detects a voltage rise.

11. The LCD power source control circuit according to claim 5, wherein said discharge electric current restriction means is a resistor connected in series between said LCD power source supply/interruption means and said compulsory discharge means.

12. The LCD power source control circuit according to claim 6, wherein said discharge electric current restriction means is a resistor connected in series between said LCD power source supply/interruption means and said compulsory discharge means.

13. The LCD power source control circuit according to claim 7, wherein said LCD power source supply/interruption means is formed comprising a first control switching element connected to earth and a plurality of resistors in addition to said drive switching elements.

14. The LCD power source control circuit according to claim 8, wherein said LCD power source supply/interruption means is formed comprising a first control switching element connected to earth and a plurality of resistors in addition to said drive switching element.

15. The LCD power source control circuit according to claim 9, wherein said LCD power source supply/interruption means is formed comprising a first control switching element connected to earth and a plurality of resistors in addition to said drive switching element.

16. The LCD power source control circuit according to claim 10, wherein said LCD power source supply/interruption means is formed comprising a first control switching element connected to earth and a plurality of resistors in addition to said drive switching element.

17. The LCD power source control circuit according to claim 7, wherein said compulsory discharge means is formed comprising a second control switching element connected to a control logic circuit power source and a plurality of resistors in addition to said discharge switching element.

18. The LCD power source control circuit according to claim 8, wherein said compulsory discharge means is formed comprising a second control switching element connected to a control logic circuit power source and a plurality of resistors in addition to said discharge switching element.

19. The LCD power source control circuit according to claim 9, wherein said compulsory discharge means is formed comprising a second control switching element connected to a control logic circuit power source and a plurality of resistors in addition to said discharge switching element.

20. The LCD power source control circuit according to claim 10, wherein said compulsory discharge means is formed comprising a second control switching element connected to a control logic circuit power source and a plurality of resistors in addition to said discharge switching element.

21. The LCD power source control circuit according to claim 7, wherein said drive switching element, said discharge switching element, and first and second switching elements are transistors which have said respective characteristics.

22. The LCD power source control circuit according to claim 8, wherein said drive switching element, said discharge switching element, and first and second switching elements are transistors which have said respective characteristics.

23. The LCD power source control circuit according to claim 7, wherein said discharge switching element is a MOS FET also serving as said discharge electric current control resistor due to an internal resistor.

24. The LCD power source control circuit according to claim 8, wherein said discharge switching element is a MOS FET also serving as said discharge electric current control resistor due to an internal resistor.

25. The LCD power source control circuit according to claim 3, wherein said voltage detecting means judges that a voltage drop has been detected when the voltage of said logic circuit power source becomes lower than a predetermined threshold value and judges that a voltage rise has been detected when the voltage of said logic circuit power source becomes higher than a predetermined threshold value.

26. The LCD power source control circuit according to claim 4, wherein said voltage detecting means judges that a voltage drop has been detected when the voltage of said logic circuit power source becomes lower than a predetermined threshold value and judges that a voltage rise has been detected when the voltage of said logic circuit power source becomes higher than a predetermined threshold value.

27. The LCD power source control circuit according to claim 25, wherein said voltage detecting means does not immediately output the signal indicating a voltage rise, but delays output of the signal for a fixed time so that the signal is outputted after the voltage of said logic circuit power source is stable at a voltage of operation.

28. The LCD power source control circuit according to claim 26, wherein said voltage detecting means does not immediately output the signal indicating a voltage rise, but delays output of the signal for a fixed time so that the signal is outputted after the voltage of said logic circuit power source is stable at a voltage of operation.

29. The LCD power source control circuit according to claim 3, wherein said voltage detecting means shares a reset circuit which resets said logic circuit and control means thereof when said voltage detecting means has detected a voltage drop of said logic circuit power source and releases the reset when a voltage rise has been detected so that the control means of said logic circuit does not go out of control.

30. The LCD power source control circuit according to claim 4, wherein said voltage detecting means shares a reset circuit which resets said logic circuit and control means thereof when said voltage detecting means has detected a voltage drop of said logic circuit power source and releases the reset when a voltage rise has been detected so that the control means of said logic circuit does not go out of control.

31. The LCD power source control circuit according to claim 25, wherein said voltage detecting means shares a reset circuit which resets said logic circuit and control means thereof when said voltage detecting means has detected a voltage drop of said logic circuit power source and releases the reset when a voltage rise has been detected so that the control means of said logic circuit does not go out of control.

32. The LCD power source control circuit according to claim 26, wherein said voltage detecting means shares a reset circuit which resets said logic circuit and control means thereof when said voltage detecting means has detected a voltage drop of said logic circuit power source and releases the reset when a voltage rise has been detected so that the control means of said logic circuit does not go out of control.

33. An image forming apparatus comprising the LCD power source control circuit according to claim 3.

34. An image forming apparatus comprising the LCD power source control circuit according to claim 4.

* * * * *